US010857658B2

(12) United States Patent
Joo et al.

(10) Patent No.: US 10,857,658 B2
(45) Date of Patent: Dec. 8, 2020

(54) HYDRAULIC PERCUSSION DEVICE AND CONSTRUCTION APPARATUS HAVING THE SAME

(71) Applicants: DAEMO ENGINEERING CO., LTD., Siheung-si (KR); KOCETI (KOREA CONSTRUCTION EQUIPMENT TECHNOLOGY INSTITUTE), Gunsan-si (KR)

(72) Inventors: Jin Moo Joo, Seoul (KR); Yong Shik Park, Siheung-si (KR); Hoon Lim, Gunsan-si (KR); Bok Joong Yoon, Gunsan-si (KR)

(73) Assignees: DAEMO ENGINEERING CO., LTD., Siheung-si (KR); KOCETI (Korea Construction Equipment Technology Institute), Gunsan-si (KR)

( * ) Notice: Subject to any disclaimer, the term of this patent is extended or adjusted under 35 U.S.C. 154(b) by 167 days.

(21) Appl. No.: 16/320,793

(22) PCT Filed: Feb. 6, 2017

(86) PCT No.: PCT/KR2017/001318
§ 371 (c)(1),
(2) Date: Jan. 25, 2019

(87) PCT Pub. No.: WO2018/021642
PCT Pub. Date: Feb. 1, 2018

(65) Prior Publication Data

US 2019/0160642 A1 May 30, 2019

(30) Foreign Application Priority Data

Jul. 27, 2016 (KR) ..... 10-2016-0095578

(51) Int. Cl.
*B25D 9/14* (2006.01)
*B25D 9/04* (2006.01)
(Continued)

(52) U.S. Cl.
CPC ..... *B25D 9/04* (2013.01); *E02D 7/10* (2013.01); *E02F 3/96* (2013.01); *E02F 5/30* (2013.01);
(Continued)

(58) Field of Classification Search
CPC .... B25D 9/04; B25D 9/14; B25D 9/26; E02F 9/22
(Continued)

(56) References Cited

U.S. PATENT DOCUMENTS 4,429,751 A * 2/1984 Jackson ..... E02D 13/06 173/13
4,699,223 A * 10/1987 Noren ..... B25D 9/12 173/10
(Continued)

FOREIGN PATENT DOCUMENTS

EP 2 979 818 A1 2/2016
JP 04-289083 A 10/1992
(Continued)

OTHER PUBLICATIONS

Japanese Office Action dated Apr. 21, 2020.
(Continued)

*Primary Examiner* — Gloria R Weeks
(74) *Attorney, Agent, or Firm* — Rabin & Berdo, P.C.

(57) ABSTRACT

The present invention relates to a hydraulic percussion device and a construction apparatus having the same, the hydraulic percussion device comprising: a cylinder; a piston; a backward port connecting a front chamber of the cylinder to a hydraulic source; a forward port formed on a rear
(Continued)

chamber of the cylinder; a forward/backward valve for controlling the forward and backward movement of the piston; a control line for moving the forward/backward valve to a forward-movement location; a long-stroke port formed between the forward port and the backward port; a short-stroke port formed between the backward port on the cylinder and the long-stroke port; a shift valve disposed between the short-stroke port and the control line; a proximity sensor for detecting a bottom dead point of the piston upon the stroke on an object; and a controller for determining a striking condition on the basis of the detected bottom dead point, and transmitting a control signal to the shift valve.

25 Claims, 15 Drawing Sheets

(51) Int. Cl.
*E02D 7/10* (2006.01)
*E02F 3/96* (2006.01)
*E02F 9/22* (2006.01)
*E02F 5/30* (2006.01)

(52) U.S. Cl.
CPC ..... *E02F 5/305* (2013.01); *E02F 9/22* (2013.01); *E02F 9/2203* (2013.01)

(58) Field of Classification Search
USPC ..... 173/13, 20, 21
See application file for complete search history.

(56) References Cited

U.S. PATENT DOCUMENTS 4,799,557 A * 1/1989 Jacquemet ..... B25D 11/064 173/117
5,174,387 A 12/1992 Arndt et al.
5,320,187 A * 6/1994 Pressley ..... B25D 17/04 173/15
5,653,295 A * 8/1997 Juvonen ..... B25D 9/145 173/207
5,860,481 A 1/1999 Prokop et al.
6,877,569 B2 * 4/2005 Koskimaki ..... B25D 9/18 173/1
7,104,190 B2 * 9/2006 Dahlberg ..... B21J 7/28 100/35
7,350,593 B1 * 4/2008 Brookover ..... E21B 7/022 173/11
7,779,930 B2 * 8/2010 Lohmann ..... B25D 9/265 173/177
8,118,112 B2 * 2/2012 Juvonen ..... B25D 9/145 173/1
8,215,419 B2 * 7/2012 Plunkett ..... E21B 4/14 175/296
8,704,507 B2 4/2014 Oksman et al.
10,472,797 B2 * 11/2019 Park ..... E02D 7/10
2004/0045727 A1 * 3/2004 Allums ..... B28D 7/005 173/1
2009/0245955 A1 * 10/2009 Maillard ..... B23Q 5/326 408/1 R
2012/0250815 A1 10/2012 Oksman et al.
2013/0327551 A1 * 12/2013 Donse ..... B25D 9/18 173/1
2014/0314495 A1 * 10/2014 Arentsen ..... E02D 7/10 405/232
2015/0013794 A1 1/2015 Dirr
2015/0041163 A1 * 2/2015 McClung ..... B25B 21/02 173/1
2015/0375382 A1 * 12/2015 Autschbach ..... B25D 9/12 173/20
2016/0076216 A1 * 3/2016 Stokholm ..... E02D 7/08 173/1
2016/0279775 A1 9/2016 Lee et al.
2017/0129088 A1 * 5/2017 Kabiraj ..... B25D 9/26

FOREIGN PATENT DOCUMENTS

JP 08-042277 A 2/1996
JP H08-042277 A 2/1996
JP 2000-237975 A 9/2000
JP 3202493 B2 8/2001
JP 2003-311651 A 11/2003
JP 2015-511541 A 4/2015
JP 2016-010844 A 1/2016
JP 2017-031467 A 2/2017
JP 2017-127917 A 7/2017
KR 10-2009-0054105 A 5/2005
KR 10-0810598 B1 3/2008
KR 10-2015-0036848 A 4/2015
KR 10-1550899 B1 9/2015
KR 10-2016-0015487 A 2/2016
KR 20160015487 A 2/2016
RU 2260121 C1 9/2005
RU 2480587 C1 4/2013
WO WO-2011-077001 A1 6/2011

OTHER PUBLICATIONS

European Search Report dated May 29, 2020.
Indian Examination Report dated Jun. 19, 2020.
Russian Patent Application No. 2019102016_Search Report dated Jun. 25, 2019 and its English Translation.

* cited by examiner

FIG. 11

| SENSOR POSITION | REAR END | MIDDLE END | FRONT END |
|---|---|---|---|
| SECTION 1: VERY HARD ROCK | X | X | X |
| SECTION 2: HARD ROCK | O | X | X |
| SECTION 3: MEDIUM ROCK | O | O | X |
| SECTION 4: SOFT ROCK | O | O | O |

HYDRAULIC PERCUSSION DEVICE AND CONSTRUCTION APPARATUS HAVING THE SAME

TECHNICAL FIELD

The present invention relates to a hydraulic percussion device and construction equipment having the same, and more specifically, to a hydraulic percussion device of which the stroke distance is adjusted according to a breaking condition, and construction equipment having the same.

BACKGROUND ART

A breaker is a device used to break rock and the like by breaking an object with a chisel, and a hydraulic attachment type breaker mounted on a heavy equipment vehicle, such as an excavator, is mainly used in a large construction field and the like.

In the rock crushing work, a work speed acts as one important factor because of construction deadline. Therefore, a mode of the conventional breaker is switched according to a worker's operation between a long stroke mode, having a long stroke distance of a piston to enhance breaking force to break a hard rock, and a short stroke mode in which a breaking speed is increased although breaking force is somewhat sacrificed.

However, since the conventional breaker entirely relies on an arbitrary determination of a worker to select the mode, it is difficult for an unskilled person to use the breaker, and it is difficult to operate the breaker when a mode is frequently switched.

Technical Problem

The present invention is directed to providing a hydraulic percussion device of which the stroke distance is adjusted according to a breaking condition, and construction equipment having the same.

An object to be accomplished by the invention is not limited to the above-described object, and other objects which are not described will be understood by those skilled in the art from the following descriptions and accompanying drawings.

Technical Solution

According to one aspect of the present invention, there is provided a percussion device that breaks an object, the device comprising: a cylinder for housing a piston; a piston for reciprocating in the cylinder; a backward port for connecting a front chamber being located at a front side of the cylinder to a hydraulic source; a forward port being formed in a rear chamber being located at a rear side of the cylinder; a forward-backward valve for controlling forward motion and backward motion of the piston by being positioned at one of a forward position for connecting the forward port to the hydraulic source and inducing the piston to move forward and a backward position for connecting the forward port to a hydraulic discharge line and inducing the piston to move backward; a control line for moving the forward-backward valve to the forward position when being connected to the hydraulic source; a long-stroke port for connecting the hydraulic source to the control line through the rear chamber when the piston is moved backward to a first position, the long-stroke port being formed between the backward port and the forward fort and being connected to the control line; a short-stroke port being connected to the hydraulic source through the rear chamber when the piston is moved to a second position which is closer to the front side of the cylinder than the first position, the short-stroke port being formed between the backward port and the long-stroke port and being connected to the control line; a transmission valve being positioned between the short-stroke port and the control line and being positioned at one of a long-stroke position for disconnecting the short-stroke port to the control line and a short-stroke position for connecting the short-stroke port to the control line; a proximity sensor for detecting a bottom dead point of the piston when the target is broken; and a controller configured to: determine a breaking condition based on the detected bottom dead point and transmit a control signal to the transmission valve based on the determined breaking condition, wherein when the transmission valve is positioned at the long-stroke position, the piston receives a forward force from a time point when the piston is retreated back to the first position and operates as a long-stroke, and when the transmission valve is positioned at the short-stroke position, the piston receives a forward force from a time point when the piston is retreated to the second position where the piston is located before being retreated to the first position and operates as a short-stroke being shorter than the long-stroke.

According to another aspect of the present invention, there is provided a percussion device, provided as a breaker that is equipped on an end of a boom or an arm of excavator for breaking rock, the device comprising: a cylinder; a piston for reciprocating in the cylinder; a chisel for breaking the rock by a reciprocating motion of the piston; a solenoid valve for regulating a forward position which a hydraulic pressure for guiding a forward force to the piston is applied to either a first position of the cylinder or a second position backward to the first position; a proximity sensor for detecting a bottom dead point to the piston when the rock is broken, a controller configured to: determines a characteristics of the rock based on the bottom dead point which is detected and transmits an electronic signal for controlling the solenoid valve according to the characteristics of the rock.

According to yet another aspect of the present invention, there is provided a percussion device comprising: a piston for reciprocating and breaking a chisel that crushes an object; a proximity sensor for detecting a bottom dead point to the piston when the piston breaks the chisel; a solenoid transmission valve for regulating a reciprocating motion of the piston to a long-stroke mode or a short-stroke mode; and a controller configured to: generates a duty cycle signal based on the detected bottom dead point and continuously shifts the reciprocation motion between the long-stroke mode and the short-stroke mode so that the solenoid transmission valve performs the long-stroke mode and the short-stroke mode in a time division manner by using the duty cycle.

According to yet another aspect of the present invention, there is provided a construction equipment comprising: an above-described percussion device; and an excavator; being equipped with on the percussion device.

The solution of the problem of the present invention is not limited to the above-described solutions, and the solution that is not described will become apparent to those skilled in the art from the description and the accompanying drawings.

Advantageous Effects

According to the present invention, a stroke distance is adjusted according to a breaking condition, and thus the stroke distance can be automatically adjusted without separate adjustment when a worker crushes a hard or soft rock.

The effect of the invention is not limited to the above-described described effect, and other effects which are not described will be understood by those skilled in the art from the following descriptions and accompanying drawings.

DESCRIPTION OF DRAWINGS

FIG. 11 is a table for determining hardness of an object to be broken according to a detection result of the proximity sensor disposed according to FIG. 6.

BEST MODE

Figure 1:
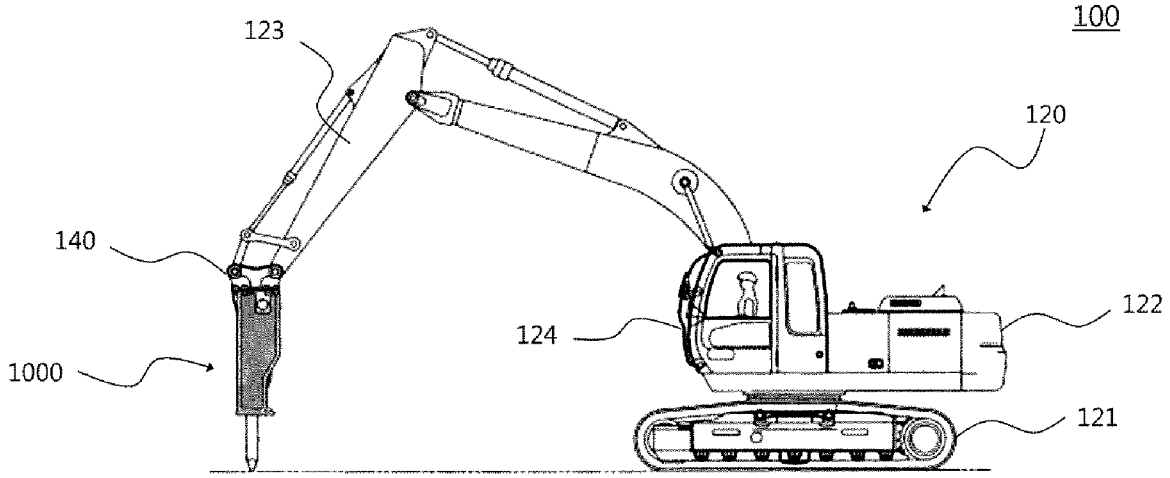
FIG. 1 is a schematic view of construction equipment according to an embodiment of the present invention.

Since embodiments described in this specification are for clearly describing the concept of the present invention to those skilled in the art, the present invention is not limited to the embodiment described in the specification, and it should be recognized that the scope of the present invention is included in a modified example without departing from the spirit of the present invention.

The terms used in this specification are selected from currently widely used general terms in consideration of functions of the present invention but may vary according to the intentions or practices of those skilled in the art or the advent of new technology. However, when the specific terms are defined and used with arbitrary meanings, the meanings of the terms are separately disclosed. Therefore, the terms used in this specification should be interpreted on the basis of substantial meanings that the terms have and the contents through this specification, not the simple names of the terms.

The drawings appended in the present specification are for easily describing the present invention, and shapes shown in the drawings may be exaggeratedly illustrated as needed in order to assist understanding the present invention, and therefore the present invention is not limited by the drawings.

In this specification, when the detailed description of the relevant known function or configuration is determined to unnecessarily obscure the important point of the present invention, the detailed description will be omitted.

According to one aspect of the present invention, there is provided a percussion device that breaks an object, the device comprising: a cylinder for housing a piston; a piston for reciprocating in the cylinder; a backward port for connecting a front chamber being located at a front side of the cylinder to a hydraulic source; a forward port being formed in a rear chamber being located at a rear side of the cylinder; a forward-backward valve for controlling forward motion and backward motion of the piston by being positioned at one of a forward position for connecting the forward port to the hydraulic source and inducing the piston to move forward and a backward position for connecting the forward port to a hydraulic discharge line and inducing the piston to move backward; a control line for moving the forward-backward valve to the forward position when being connected to the hydraulic source; a long-stroke port for connecting the hydraulic source to the control line through the rear chamber when the piston is moved backward to a first position, the long-stroke port being formed between the backward port and the forward fort and being connected to the control line; a short-stroke port being connected to the hydraulic source through the rear chamber when the piston is moved to a second position which is closer to the front side of the cylinder than the first position, the short-stroke port being formed between the backward port and the long-stroke port and being connected to the control line; a transmission valve being positioned between the short-stroke port and the control line and being positioned at one of a long-stroke position for disconnecting the short-stroke port to the control line and a short-stroke position for connecting the short-stroke port to the control line; a proximity sensor for detecting a bottom dead point of the piston when the target is broken; and a controller configured to: determine a breaking condition based on the detected bottom dead point and transmit a control signal to the transmission valve based on the determined breaking condition, wherein when the transmission valve is positioned at the long-stroke position, the piston receives a forward force from a time point when the piston is retreated back to the first position and operates as a long-stroke, and when the transmission valve is positioned at the short-stroke position, the piston receives a forward force from a time point when the piston is retreated to the second position where the piston is located before being retreated to the first position and operates as a short-stroke being shorter than the long-stroke.

Herein, the proximity sensor may be installed in the cylinder toward the piston and detect whether a large diameter portion of the piston is located on an installation point.

Herein, the proximity sensor may detect a maximum of the forward position when the object is broken.

Herein, the proximity sensor may comprise each of a plurality of sensors that is installed along a reciprocating direction of the piston.

Herein, the controller may determine the breaking condition based on a combination of on/off signals of each of the plurality of sensors.

Herein, the controller may determine the breaking condition based on a sensor closest to a front end of the cylinder among each of the plurality of sensors that are on-state.

Herein, the controller may determine the breaking condition by further considering a timing of on/off signals of each of the plurality of sensors.

Herein, the controller may determine the breaking condition based on the combination of on/off signals when a timing at which each of the plurality of sensors is turned on is an order of sensor which is close to the front end of the cylinder from a sensor close to a rear end of the cylinder, and suspends a determination of the breaking condition based on the combination of on/off signals when the timing at which each of the plurality of sensors is turned on is turned on is an order of sensor which is close to the rear end of the cylinder from a sensor close to the front end of the cylinder.

Herein, the breaking condition may be a characteristics of rock comprising at least a hard rock and a soft rock.

Herein, the controller may control the transmission valve to the long-stroke position when the bottom dead point of the piston is equal to or less than a predetermined position and controls the transmission valve to the short-stroke position when the bottom dead point of the piston is equal to or greater than the predetermined position based on the proximity sensor.

Herein, the controller may control position of the transmission valve by controlling whether a power is applied to the transmission valve.

Herein, the controller may disconnect the power to the transmission valve to control the transmission valve to the long-stroke position and the controller applies the power to the transmission valve to control the transmission valve to the short-stroke position.

Herein, the controller and the proximity sensor may communicate with each other using Zigbee or Bluetooth.

Herein, the controller may transmit a pulse signal having a cycle shorter than a reciprocating cycle of the piston and wherein the transmission valve may move between the long-stroke position and the short-stroke position a plurality of times during one reciprocating cycle of the piston, so that the piston operates as a middle stroke having a middle distance between the long-stroke and the short-stroke.

Herein, the controller may control a length of the middle stroke by controlling a width of the pulse signal with respect to a cycle of the pulse signal.

Herein, the percussion device may comprise at least a hydraulic breaker used for rock crushing and a hydraulic hammer used for pile driving.

Herein, the percussion device may be an attachment type equipped on a boom or an arm of an excavator.

According to another aspect of the present invention, there is provided a percussion device, provided as a breaker that is equipped on an end of a boom or an arm of excavator for breaking rock, the device comprising: a cylinder; a piston for reciprocating in the cylinder; a chisel for breaking the rock by a reciprocating motion of the piston; a solenoid valve for regulating a forward position which a hydraulic pressure for guiding a forward force to the piston is applied to either a first position of the cylinder or a second position backward to the first position; a proximity sensor for detecting a bottom dead point to the piston when the rock is broken, a controller configured to: determines a characteristics of the rock based on the bottom dead point which is detected and transmits an electronic signal for controlling the solenoid valve according to the characteristics of the rock.

Herein, the controller may determine that the rock is hard as the bottom dead point is closer to a front end of the cylinder than a predetermined bottom dead point.

Herein, the controller may control the solenoid valve to adjust the forward position to the first position when the characteristics of the rock is soft rock and to adjust the forward position to the second position when the characteristics of the rock is hard rock.

Herein, the controller may adjust the forward position to the first position for a part of a reciprocating cycle of the piston and may adjust the forward position to the second position for other part of the reciprocating cycle of the piston when the characteristics of the rock is between the soft rock and the hard rock.

Herein, the controller may transmit the electronic signal as a pulse signal and controls a width of the pulse signal with respect to a cycle of the pulse signal.

According to yet another aspect of the present invention, there is provided a percussion device comprising: a piston for reciprocating and breaking a chisel that crushes an object; a proximity sensor for detecting a bottom dead point to the piston when the piston breaks the chisel; a solenoid transmission valve for regulating a reciprocating motion of the piston to a long-stroke mode or a short-stroke mode; and a controller configured to: generates a duty cycle signal based on the detected bottom dead point and continuously shifts the reciprocation motion between the long-stroke mode and the short-stroke mode so that the solenoid transmission valve performs the long-stroke mode and the short-stroke mode in a time division manner by using the duty cycle.

According to yet another aspect of the present invention, there is provided a construction equipment comprising: an above-described percussion device; and an excavator; being equipped with on the percussion device.

Herein, the controller may be installed in the excavator.

Hereinafter, construction equipment 100 according to an embodiment of the present invention will be described with reference to FIG. 1.

FIG. 1 is a schematic view of construction equipment according to the embodiment of the present invention.

The construction equipment 100 according to the embodiment of the present invention is a device for performing a breaking work on an object. The construction equipment 100 for the breaking work is formed in a form in which a hydraulic percussion device 1000 is commonly mounted on heavy equipment, such as an excavator and the like, as an attachment.

The percussion device 1000 is a device for performing an operation of breaking the object. A representative example of the percussion device 1000 includes a hydraulic breaker breaking a rock or a hydraulic hammer pressing and fitting a pile. The percussion device 1000 in the present invention is not limited to the above-described example and should be understood as a concept including different types of percussion devices that perform a function of breaking an object in addition to the hydraulic breaker or the hydraulic hammer. The percussion device 1000 is generally formed as an attachment type to be mounted on a heavy equipment vehicle, that is, a carrier 120, but the present invention is not limited thereto, and the percussion device 1000 may be formed to be separated from the carrier 120 so as to be directly handled by a worker.

The percussion device 1000 will be described in more detail below.

The carrier 120 may be mainly classified into a driving body 121 and a rotating body 122. The driving body 121 is generally provided as a crawler type or a wheel type or may be provided as a crane or a truck type in some cases. The rotating body 122 is rotatably mounted on the driving body 121 in a vertical direction.

The rotating body 122 includes a connecting member 123, such as a boom, an arm, or the like, installed thereon. The percussion device 1000 is directly coupled to an end portion of the connecting member 123 as an attachment type or may be attached or detached in a manner of being attached through a coupler 140.

The connecting member 123 commonly has at least two members coupled to each other in a linked manner and is connected with a hydraulic cylinder 1430 to perform bending, unbending, expansion operations, or the like by expansion of the hydraulic cylinder 1430. The connecting member 123 may position the percussion device 1000, attached to the end portion thereof, on an object to be broken by the operations.

Further, the carrier 120 includes a hydraulic source 160 for applying a hydraulic pressure to the percussion device 1000 so that the mounted percussion device 1000 is operated or for supplying a hydraulic pressure to each part of the carrier 120, such as a boom or an arm, or a coupler 140, and a hydraulic tank 160*a* for storing a working fluid.

Further, a cabin 124 in which a worker rides is provided on the rotating body 122 to allow a worker to operate the carrier 120 or the percussion device 1000 using an operation member, such as a handle, a lever, or a button, in the cabin 124.

In addition, the carrier 120 may include an outrigger (not shown) for stably fixing the construction equipment 100 to the ground or a counter weight (not shown) for stabilizing a balance of the construction equipment 100.

Hereinafter, the percussion device 1000 according to the embodiment of the present invention will be described with reference to FIGS. 2 and 3.

Figure 2:
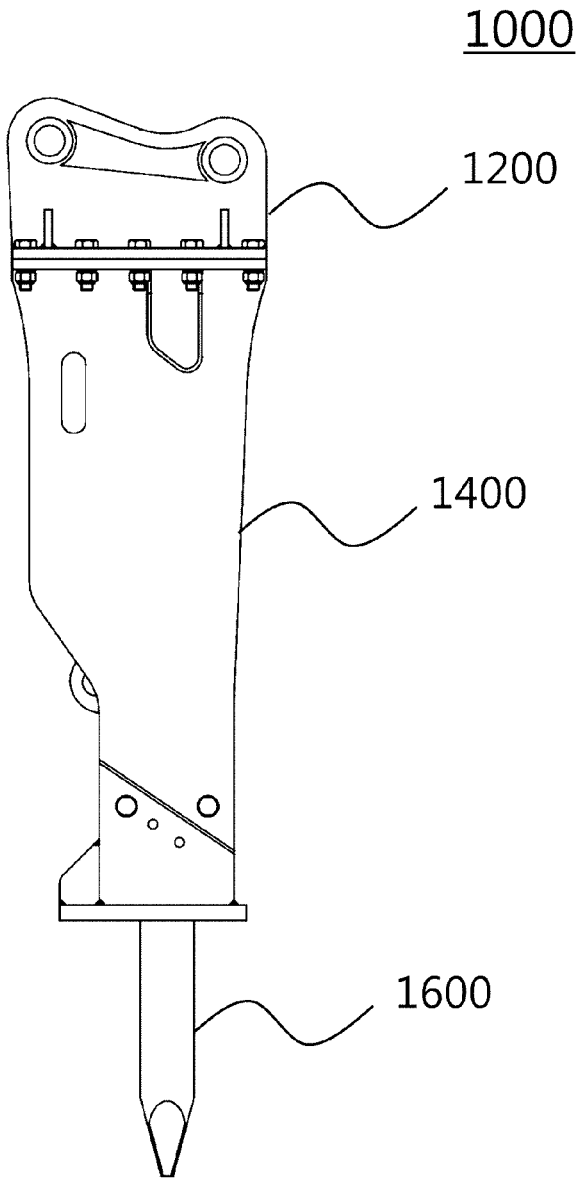
FIG. 2 is a schematic view of a percussion device according to an embodiment of the present invention.
Figure 3:
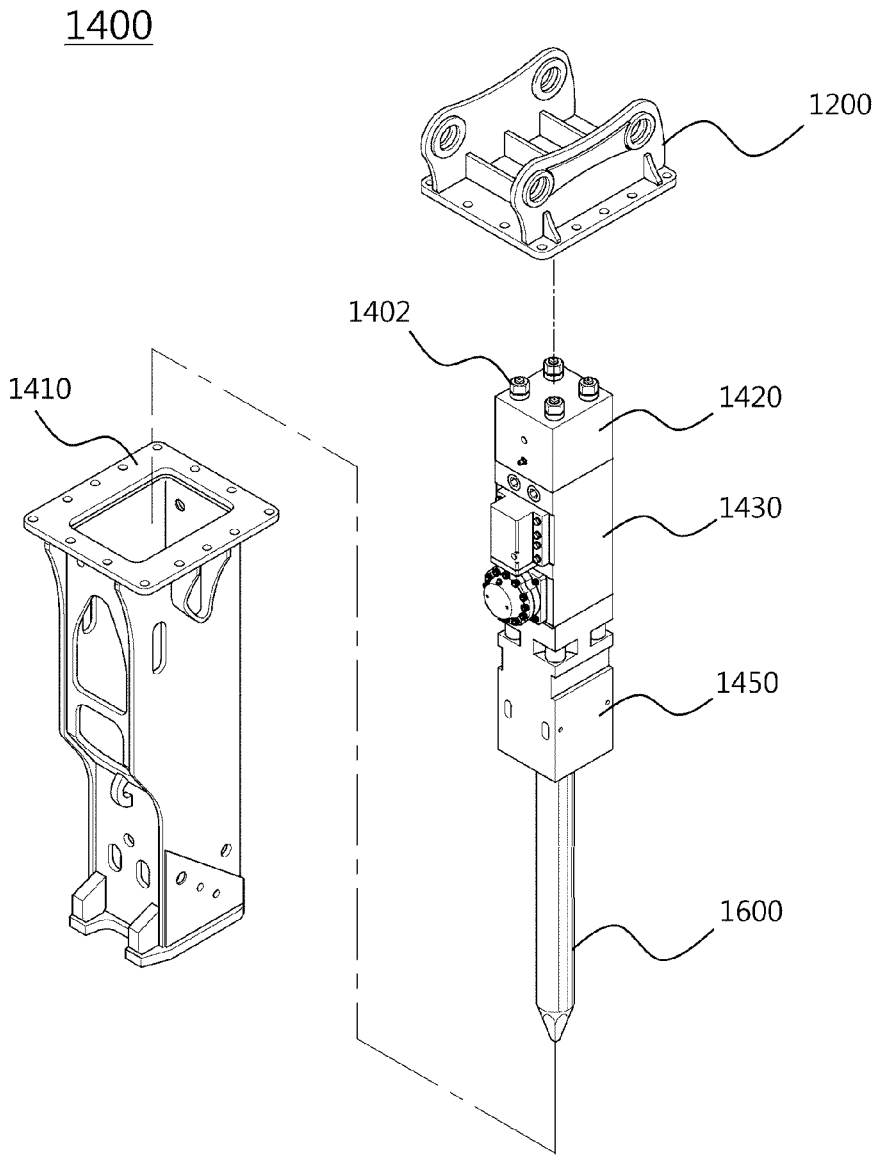
FIG. 3 is an exploded perspective view of the percussion device according to the embodiment of the present invention.

FIG. 2 is a schematic view of the percussion device 1000 according to the embodiment of the present invention, and FIG. 3 is an exploded perspective view of the percussion device 1000 according to the embodiment of the present invention.

The percussion device 1000 may include a mounting bracket 1200, a main body 1400, and a chisel 1600. The main body 1400, which is a part for generating breaking force from the percussion device 1000, includes a cylinder 1430 and a piston 1440 accommodated in the cylinder 1430 to allow the piston 1440 to reciprocate by a hydraulic pressure applied from the hydraulic source 160 so as to generate breaking force. The chisel 1600, which is a part that directly breaks an object to be broken, is disposed on a front side of the main body 1400 (in the following description, a direction in which the piston 1440 moves forward (expands) is defined as a front direction, and a direction in which the piston 1440 moves backward (contracts) is defined as a rear direction) so that a rear end thereof is hit by a front end of the piston 1440 when the piston 1440 expands. The mounting bracket 1200 is coupled to a rear end of the main body 1400, and is a part for connecting the carrier 120 to the percussion device 1000.

Main components of the main body 1400 are the cylinder 1430 and the piston 1440.

The piston 1440 is provided in a cylindrical shape, and the cylinder 1430 is provided in a hollow cylindrical shape so that the piston 1440 is inserted thereinto to reciprocate. Various hydraulic ports are provided on an inner wall of the cylinder 1430 to supply a hydraulic pressure to the inside of the cylinder 1430 or discharge a hydraulic pressure from the inside of the cylinder 1430. At least two large diameter portions 1442 and 1444 and a small diameter portion 1446 provided there between are provided in a longitudinal direction of the piston 1440. When the hydraulic pressure applied to the inside of the cylinder 1430 through the hydraulic ports is applied to stepped surfaces 1442*a* and 1444*a* formed by the large diameter portions 1442 and 1444, the piston 1440 reciprocates in the cylinder 1430 forward and backward.

Therefore, when the hydraulic ports formed in the cylinder 1430 or the stepped surfaces 1442*a* and 1444*a* of the piston 1440 are suitably designed, reciprocation of the piston 1440 and a stroke distance of the piston 1440 can be adjusted, but detailed descriptions thereof will be made below.

A front head 1450 and a head cap 1420 are connected to a front end and a rear end of the cylinder 1430.

The front head 1450 includes a chisel pin (not shown) by which the chisel 1600 is caught, and the chisel pin (not shown) allows the chisel 1600 to be disposed at an appropriate position to be hit by the front end of the piston 1440 when the piston 1440 moves forward. Further, the front head 1450 further includes a dust protector (not shown) for preventing external foreign materials from being introduced into the cylinder 1430 when the piston 1440 reciprocates, a noise absorbing member (not shown) for reducing breaking noise, and the like.

The head cap 1420 includes a gas chamber (not shown) formed therein, and when a volume of the gas chamber is compressed when the piston 1440 moves backward, the gas chamber provides a damping effect for the piston 1440 so as to prevent the rear end of the piston 1440 from colliding.

The head cap 1420, the cylinder 1430, and the front head 1450 are sequentially connected by a long bolt 1402, and a housing 1410 covers the connector, and thus the main body 1400 is formed. The chisel 1600 is inserted toward the front side of the main body 1400 through the front head 1450 and is caught by the chisel pin (not shown), and the mounting bracket 1200 is assembled to a rear end of the body 1400, and thus the percussion device 1000 is formed.

The configuration and the structure of the above-described percussion device 1000 are only the embodiment of the percussion device 1000 according to the present invention, and it should be understood that another percussion device 1000, which has a similar function to that of the above-described configuration despite having a slightly different configuration or structure, is also included in the percussion device 1000 according to the present invention.

Hereinafter, an automatic stroke distance adjustment function performed by the percussion device 1000 according to the embodiment of the present invention will be described.

When a rock is broken by the hydraulic breaker, a long stroke is required for a hard rock, and a short stroke is required for a soft rock. The hard rock requires high breaking force, and the soft rock does not, and thus it is more efficient to increase a work speed. In addition, when the hydraulic breaker performs a process of using energy greater than energy required for breaking, stress is applied to the breaker by repulsion of the remaining energy after the rock is broken, and a cavity is generated in the cylinder 1430, and thus the device is damaged. Therefore, the adjustment of the stroke distance is not only for increasing work efficiency.

The automatic stroke distance adjustment function according to the embodiment of the present invention automatically and appropriately adjusts a stroke distance of the piston 1440 according to the breaking condition.

As an example, when the percussion device 1000 is a hydraulic breaker used for breaking a rock, a stroke distance can be adjusted based on hardness of the object to be broken as a breaking condition.

For another example, when the percussion device 1000 is a hydraulic hammer used for a hitting task, a stroke distance may be adjusted based on the breaking force required for inserting a pile as a breaking condition.

Specifically, the automatic stroke distance adjustment function is performed by detecting a signal reflecting a breaking condition, determining the breaking condition based on the detected result, and selecting a stroke mode which is appropriate for the determined breaking condition. In this case, the representative example of the signal reflecting the breaking condition includes vibration generated while breaking is performed or a distance by which the piston 1440 is moved backward by a repulsive force after the breaking. In addition, the magnitude of noise generated by breaking, the forward movement distance (the maximum forward position and the bottom dead point) when the piston 1440 moves forward, and the like may be used as a signal reflecting the breaking condition.

In the below description, various examples of a circuit of the percussion device 1000 for performing the automatic stroke distance adjustment function according to the above-described embodiment of the present invention will be described. However, since the circuit diagrams described below are only for performing the automatic stroke distance adjustment function, the present invention is not limited thereto, and it should be understood that various modified examples of the circuit diagram described below are also included in the present invention without departing from the concept of the present invention.

The circuit diagrams of the percussion device 1000 according to the embodiment of the present invention will be described with reference with FIGS. 4 and 5.

Figure 4:
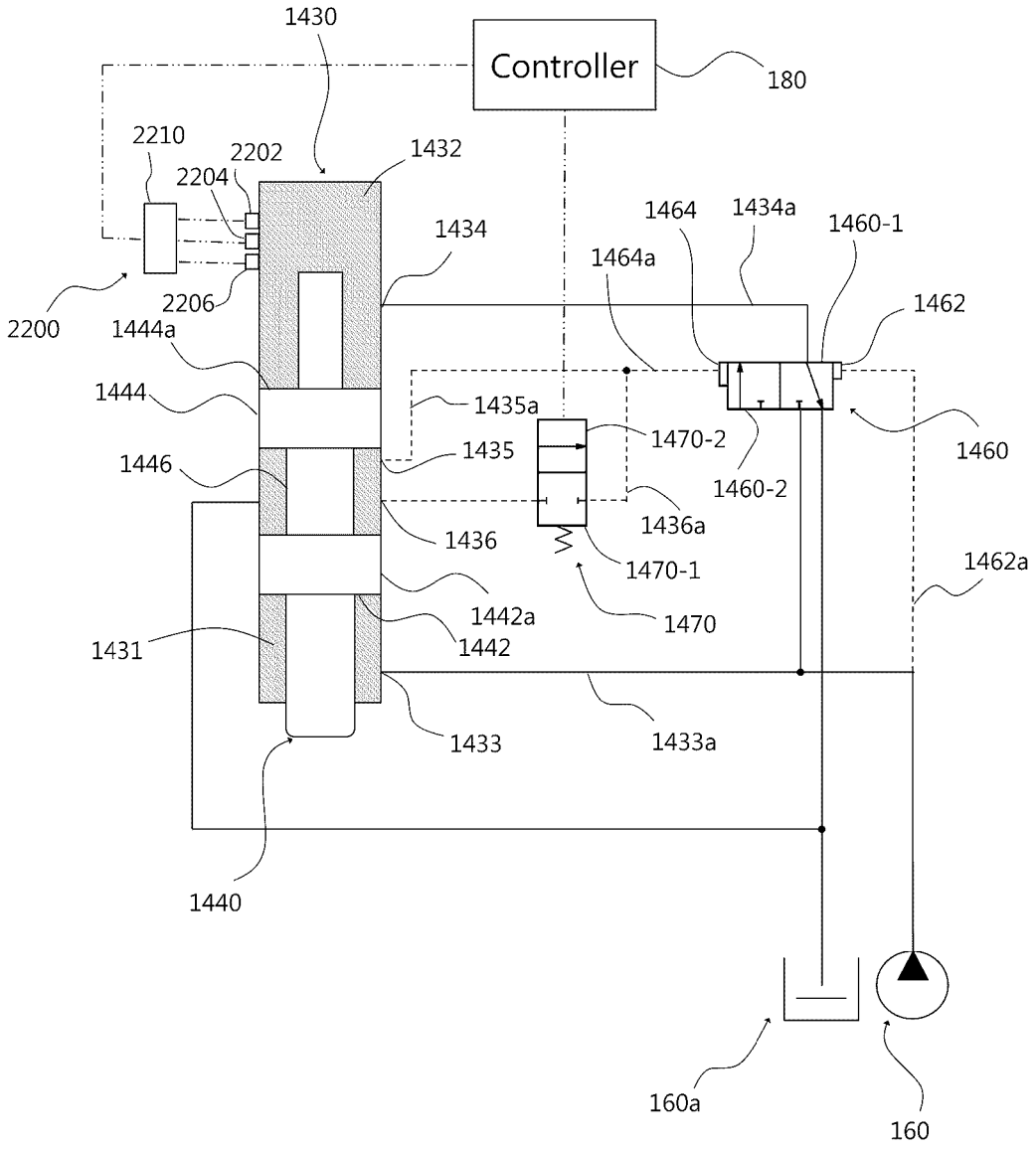
FIG. 4 is a first example of a circuit diagram of the percussion device according to the embodiment of the present invention.
Figure 5:
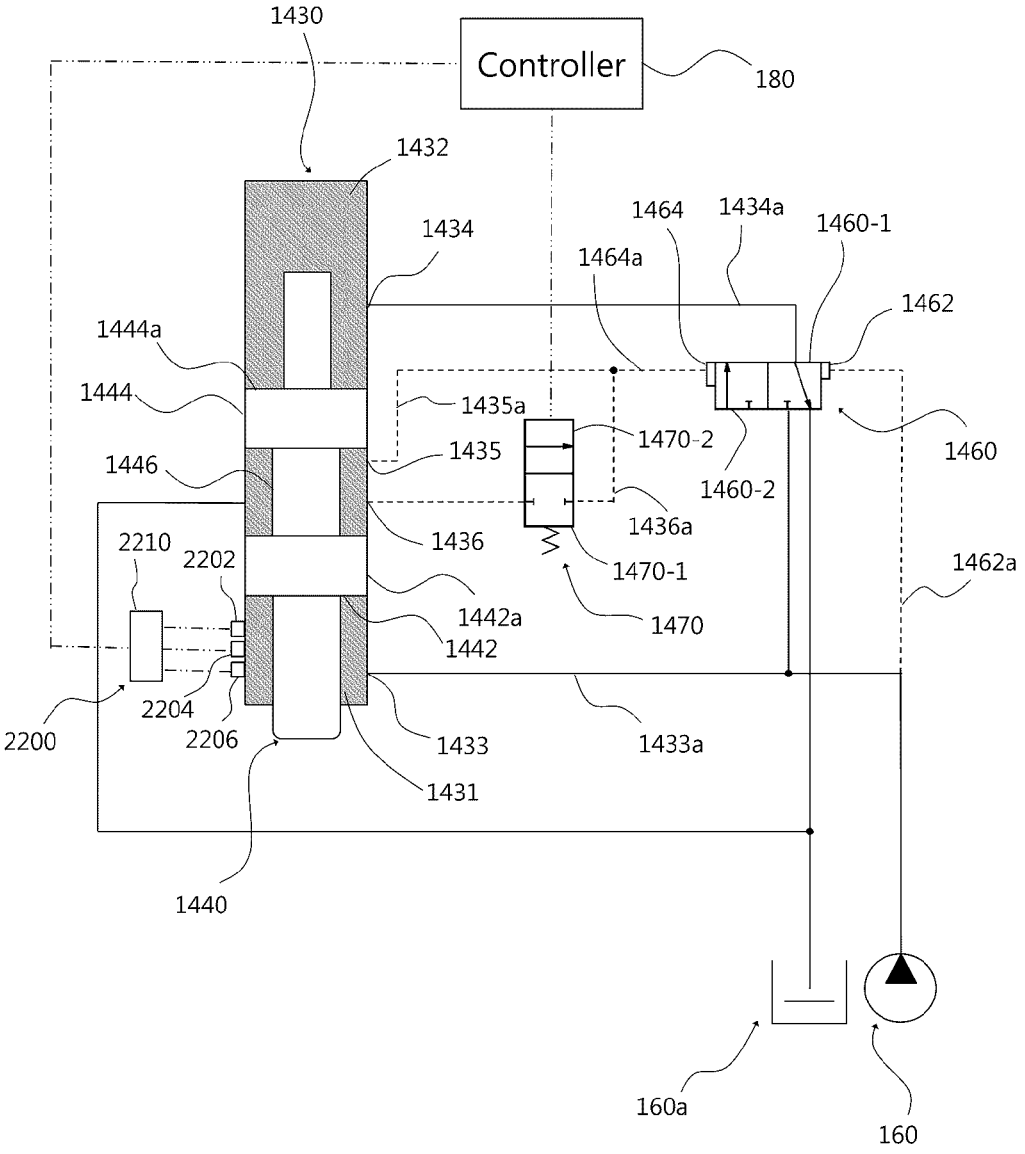
FIG. 5 is a second example of the circuit diagram of the percussion device according to the embodiment of the present invention.

FIG. 4 is a first example of a circuit diagram of the percussion device according to the embodiment of the present invention, and FIG. 5 is a second example of the circuit diagram of the percussion device according to the embodiment of the present invention.

Referring to FIGS. 4 and 5, the piston 1440 is inserted into the cylinder 1430, and the chisel 1600 is disposed on a front end of the piston 1440.

The piston 1440 includes the front large diameter portion 1442 and the rear large diameter portion 1444, and the small diameter portion 1446 is formed between the front large diameter portion 1442 and the rear large diameter portion 1444. The outer diameter of the large diameter portion is substantially the same as the inner diameter of the cylinder 1430, and thus a front chamber 1431 is formed between a front portion of the cylinder 1430 and the front large diameter portion 1442 in the cylinder 1430, and a rear chamber 1432 is formed between a rear portion of the cylinder 1430 and the rear large diameter portion 1444.

The front chamber 1431 includes a backward port 1433, and the backward port 1433 is connected with the hydraulic source 160 through a backward line 1433*a*.

Therefore, hydraulic pressure may be applied to the front chamber 1431 by working fluid introduced from the hydraulic source 160 to the backward port 1433 through the backward line 1433*a*. The hydraulic pressure applied to the front chamber 1431 is applied to the stepped surface 1442*a* of the front large diameter portion 1442, and backward force is applied to the piston 1440.

The rear chamber 1432 includes a front port 1434, and the front port 1434 is connected with a forward-backward valve 1460 through a forward line 1434*a*. The forward-backward valve 1460 may be disposed at any one of a forward position 1460-2 or a backward position 1460-1, the forward line 1434*a* is connected with the hydraulic source 160 at the forward position 1460-2, and the forward line 1434*a* is connected with the hydraulic tank 160*a* at the backward position 1460-1.

Therefore, when the forward-backward valve 1460 is disposed at the forward position 1460-2, a hydraulic pressure may be applied to the rear chamber 1432 by working fluid introduced from the hydraulic source 160 to the front port 1434 through the forward-backward valve 1460 and the forward line 1434*a*. The hydraulic pressure applied to the rear chamber 1432 is applied to the stepped surface 1444*a* of the rear large diameter portion 1444, and forward force is applied to the piston 1440.

Further, when the forward-backward valve 1460 is disposed at the backward position 1460-1, the rear chamber 1432 is connected with the hydraulic tank 160*a* through the forward line 1434*a* and the forward-backward valve 1460 and discharges the working fluid, introduced at the forward position 1460-2, to the hydraulic tank 160*a*.

In this structure, since the stepped surface 1444*a* of the rear large diameter portion 1444 has a larger area than the stepped surface 1442*a* of the front large diameter portion 1442, when the forward-backward valve 1460 is disposed at the forward position 1460-2, forward force is greater than backward force, and thus the piston 1440 may move forward. Conversely, when the forward-backward valve 1460 is disposed at the backward position 1460-1, the hydraulic pressure applied from the hydraulic source 160 is applied to only the stepped surface 1442*a* of the front large diameter portion 1442, and thus the piston 1440 may move backward. Accordingly, since the forward-backward valve 1460 is disposed at the forward position 1460-2 or the backward position 1460-1, the piston 1440 may be induced to reciprocate.

A position of the forward-backward valve 1460 may be adjusted in a hydraulic manner. That is, the forward-backward valve 1460 may be a hydraulic valve for selecting the forward position 1460-2 and the backward position 1460-1 according to an input hydraulic signal.

A forward working surface 1464 and a backward working surface 1462 connected to the hydraulic lines may be provided on both ends of the hydraulic forward-backward valve 1460. In this case, the forward working surface 1464 is connected with a forward control line 1464*a* branched into a long stroke line 1435*a* and a short stroke line 1436*a*. Further, the backward working surface 1462 is connected with the hydraulic source 160 through a backward control line 1462*a*.

In this structure, since the forward working surface 1464 has a larger area than that of the backward working surface 1462, when a hydraulic pressure is applied to both working surfaces 1462 and 1464, the forward-backward valve 1460 may be disposed on the forward position 1460-2, and thus the piston 1440 may move forward. Conversely, when the hydraulic pressure applied from the hydraulic source 160 is applied to only the backward working surface 1462, the forward-backward valve 1460 may be disposed at the backward position 1460-1, and thus the piston 1440 may move backward.

In other words, when at least one of the long stroke line 1435*a* and the short stroke line 1436*a* connected with the forward control line 1464*a* is connected with the hydraulic source 160, the piston 1440 may move forward. When both of the long stroke line 1435*a* and the short stroke line 1436*a* are blocked from the hydraulic source 160, the piston 1440 may move backward.

The long stroke line 1435*a* is connected with the long stroke port 1435 formed in the cylinder 1430. The long stroke port 1435 may be formed between the front port 1434 and the backward port 1433 of the cylinder 1430 to be connected with or blocked from the front chamber 1431 according to a position of the piston 1440.

Specifically, the long stroke port 1435 is blocked from the front chamber 1431 when the piston 1440 moves forward so that the front large diameter portion 1442 is positioned on the long stroke port 1435 or in front of the long stroke port 1435. Conversely, the long stroke port 1435 is connected with the front chamber 1431 when the piston 1440 moves backward so that the front large diameter portion 1442 is positioned behind the long stroke port 1435.

Therefore, when the long stroke port 1435 is connected with the front chamber 1431, a hydraulic pressure is applied from the hydraulic source 160 to the forward working surface 1464 through the backward line 1433*a*, the backward port 1433, the front chamber 1431, the long stroke port 1435, the long stroke line 1435*a*, and the forward control line 1464*a*, and the forward-backward valve 1460 may be disposed at the forward position 1460-2.

The short stroke line 1436*a* may be connected with a short stroke port 1436 formed in the cylinder 1430. The short stroke port 1436 is formed between the front port 1434 and the backward port 1433 of the cylinder 1430 to be connected with or blocked from the front chamber 1431 according to a position of the piston 1440 and may be formed at a position closer to the backward port 1433 than the long stroke port 1435.

Specifically, the short stroke port 1436 is blocked from the front chamber 1431 when the piston 1440 moves forward so that the front large diameter portion 1442 is positioned on the short stroke port 1436 or in front of the short stroke port 1436. Conversely, the short stroke port 1436 is connected with the front chamber 1431 when the piston 1440 moves backward so that the front large diameter portion 1442 is positioned behind the short stroke port 1436.

In this case, a transmission valve 1470 for controlling a short circuit of the short stroke line 1436*a* is formed on the short stroke line 1436*a*. The transmission valve 1470 may be disposed at any one of the long stroke position 1470-1 and the short stroke position 1470-2 and blocks the short stroke line 1436*a* at the long stroke position 1470-1 and connects the short stroke line 1436*a* at the short stroke position 1470-2.

Therefore, when the short stroke port 1436 is connected with the front chamber 1431, the transmission valve 1470 may determine whether the hydraulic pressure is applied from the hydraulic source 160 to the forward working surface 1464 through the backward line 1433*a*, the backward port 1433, the front chamber 1431, the long stroke port 1435, the long stroke line 1435*a*, and the forward control line 1464*a*. In this case, when the transmission valve 1470 is a short stroke position 1470-2, the short stroke line 1436*a* is disconnected, and the forward-backward valve 1460 is disposed at the backward position 1460-1 by a hydraulic pressure applied through the backward control line 1462*a*, and when the transmission valve 1470 is turned on, the forward-backward valve 1460 may be disposed at the forward position 1460-2 by a hydraulic pressure applied through the forward control line 1464*a*.

The structure may allow the piston 1440 to reciprocate between a long stroke mode and a short stroke mode according to a position of the transmission valve 1470.

In the long stroke mode, the transmission valve 1470 is positioned at the long stroke position 1470-1.

In this state, when the piston 1440 moves forward, the long stroke port 1435 is blocked from the front chamber 1431 by the front large diameter portion 1442, and the forward-backward valve 1460 is disposed at the backward position 1460-1, and a hydraulic pressure from the hydraulic source 160 is not transmitted to the stepped surface 1444*a* of the rear large diameter portion 1444 of the piston 1440, and thus the piston 1440 moves backward.

In this state, when the piston 1440 moves backward and the front large diameter portion 1442 passes through the long stroke port 1435, the long stroke port 1435 is connected with the front chamber 1431, the forward-backward valve 1460 is disposed at the forward position 1460-2, and a hydraulic pressure from the hydraulic source 160 is transmitted to the stepped surface 1444*a* of the rear large diameter portion 1444 of the piston 1440, and thus the piston 1440 moves forward.

In this case, the front large diameter portion 1442 passes through the short stroke port 1436 before passing through the long stroke port 1435, but the short stroke line 1436*a* is disconnected by the transmission valve 1470, and the hydraulic pressure is not transmitted.

That is, in the long stroke mode, when a position of the front large diameter portion 1442 of the piston 1440 passes through the long stroke port 1435, a forward movement starts.

In the short stroke mode, the transmission valve 1470 is positioned at the short stroke position 1470-2.

In this state, when the piston 1440 moves forward, the short stroke port 1436 is blocked from the front chamber 1431 by the front large diameter portion 1442, the forward-backward valve 1460 is disposed at the backward position 1460-1, and a hydraulic pressure from the hydraulic source 160 is not transmitted to the stepped surface 1444*a* of the rear large diameter portion 1444 of the piston 1440, and thus the piston 1440 moves backward.

In this state, when the piston 1440 moves backward and the front large diameter portion 1442 passes through the short stroke port 1436, the short stroke port 1436 is connected with the front chamber 1431, and the short stroke line 1436*a* is connected by the transmission valve 1470. A hydraulic pressure is applied from a hydraulic pressure source to the forward working surface 1464 of the forward-backward valve 1460, the forward-backward valve 1460 is disposed at the forward position 1460-2, and the hydraulic pressure from the hydraulic source 160 is transmitted to the stepped surface 1444*a* of the rear large diameter portion 1444 of the piston 1440, and thus the piston 1440 moves forward.

That is, in the short stroke mode, when a position of the front large diameter portion 1442 of the piston 1440 passes through the short stroke port 1436, a forward movement starts.

In this case, the long stroke port 1435 is positioned behind the short stroke port 1436, and the forward movement starts faster in the short stroke mode than in the long stroke mode, and thus a backward movement distance of the piston 1440 is decreased, and the stroke distance is decreased.

As described above, the stroke distance may be adjusted by mode selection between the long stroke mode and the short stroke mode, and the mode is switched by the transmission valve 1470.

The transmission valve 1470 may automatically switch between the long stroke position 1470-1 and the short stroke position 1470-2 according to a breaking condition.

Specifically, a breaking condition sensor 2000 for detecting the breaking conduction may be installed on the percussion device 1000. The breaking condition sensor 2000 detects the breaking conduction and transmits a signal for the breaking condition to a controller 180, and the controller 180 transmits a control signal to the transmission valve 1470 based on the breaking condition and adjust a position of the transmission valve 1470. A solenoid valve, which is electronically controlled, may be used as the transmission valve 1470.

A proximity sensor 2200 may be used as the breaking condition sensor 2000. The proximity sensor 2200 is mounted on the percussion device 1000 to detect a position of the piston 1440 when breaking is performed.

As an example, when the piston 1440 breaks a rock using the chisel 1600, the proximity sensor 2200 may detect a maximum forward position (hereinafter, referred to as 'bottom dead point'). Specifically, the proximity sensor 2200 is inserted into a groove or a hole formed in the cylinder 1430 and may be installed in a direction perpendicular to a reciprocating motion direction of the piston 1440. Therefore, the proximity sensor 2200 may detect whether the small diameter portion or the large diameter portions 1442 and 1444 pass through an installation position of the proximity sensor 2200 while the piston reciprocates.

Further, the plurality of proximity sensors 2200 may be disposed on the cylinder 1430 in the reciprocating motion direction of the piston 1440. For example, the proximity sensor 2200 may include a rear sensor 2202, a mid-sensor 2204, and a front sensor 2206 disposed in order from a side close to the rear end of the cylinder 1430 to a side close to the front end thereof.

Referring again to FIG. 4, the proximity sensor 2200 may be provided on a rear side of the cylinder 1430 with three sensors 2202, 2204, and 2206 disposed in order from a rear side of the cylinder 1430 to a front side thereof. Each of the sensors 2202, 2204, and 2206 of the disposed proximity sensor 2200 detects the rear large diameter portion 1444. In this case, when the piston 1440 is at the maximum forward position, the sensors 2202, 2204, and 2206 are disposed around an area in which the rear stepped surface 1444*a* of the rear large diameter portion 1444 is disposed. The maximum forward position of the piston 1440 when the percussion device 1000 breaks a hard rock is formed behind the maximum forward position of the piston 1440 when the percussion device 1000 hits a soft rock. A degree to which the chisel penetrates the hard rock is less than a degree to which the chisel penetrates the soft rock. Therefore, when the proximity sensor 2200 is disposed as shown in FIG. 4, as a forward position of the piston 1440 is closer to the front end of the proximity sensor, the proximity sensor 2200 is sequentially turned off from the rear sensor 2202. For example, when each of the proximity sensors 2202, 2204, and 2206 detects more signals, the object to be broken may be close to a hard rock, and when each of the proximity sensors 2202, 2204, and 2206 detects fewer signals, the object to be broken may be close to a soft rock. In the case in which the proximity sensors 2202, 2204, and 2206 detect a front stepped surface of the rear large diameter portion 1444 at a bottom dead point of the piston 1440, when the sensors 2202, 2204, and 2206 detect more signals, the object to be broken may be a hard rock, and when the sensors 2202, 2204, and 2206 detect fewer signals, the object to be broken may be a soft rock.

Figure 6:
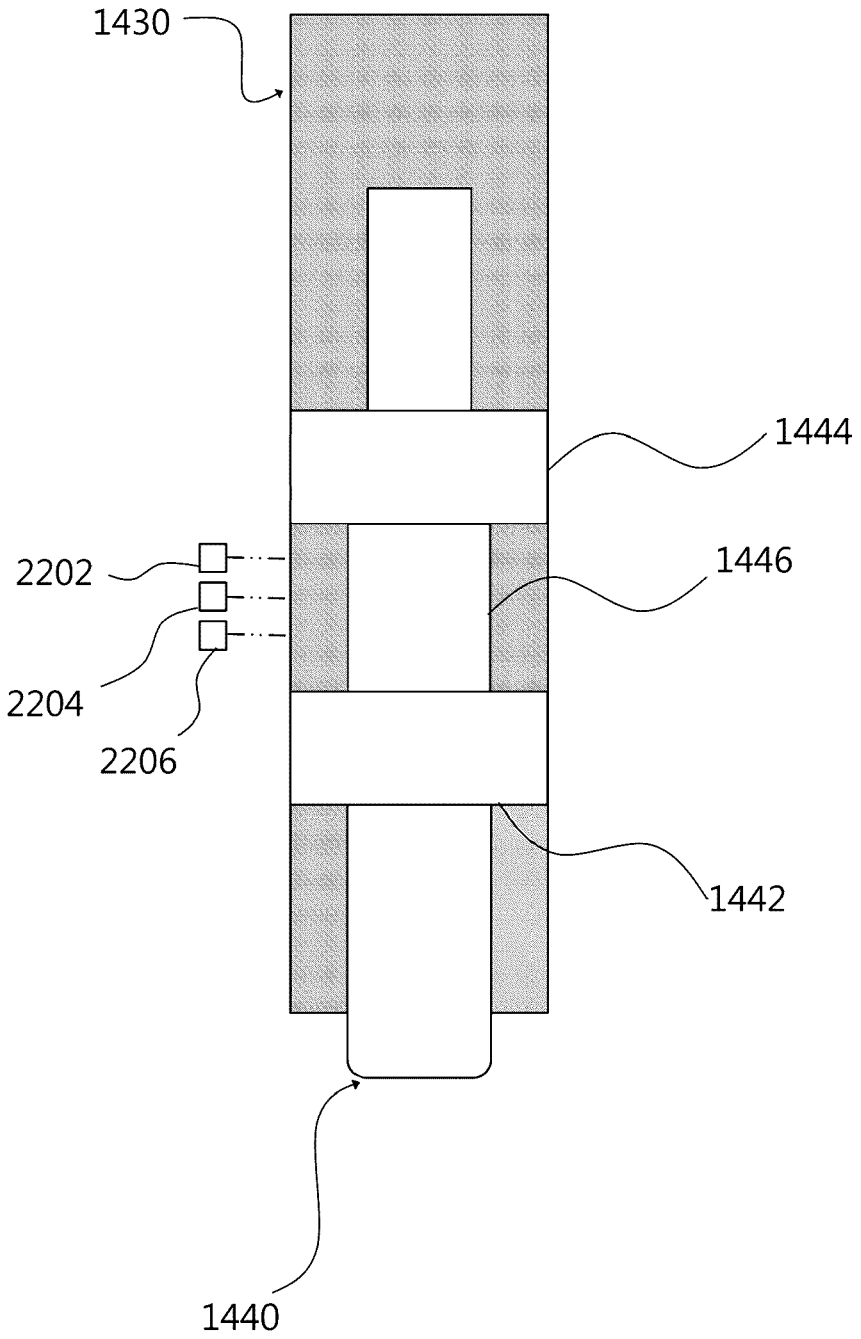
FIG. 6 is a view of an example of arrangement of a proximity sensor according to an embodiment of the present invention.

It is not necessary for the proximity sensors 2202, 2204, and 2206 to be disposed as shown in FIG. 6. When the piston 1440 is positioned at the bottom dead point, the proximity sensor 2200 may detect a front stepped surface or a rear stepped surface of the front large diameter portion 1442 or a front stepped surface or a rear stepped surface of the rear large diameter portion 1444.

Therefore, when the proximity sensor 2200 detects the front stepped surface, the proximity sensor 2200 may be positioned at a position close enough for a sensor, which is the closest to a front end of the piston 1440, of the proximity sensor 2200 to detect a stepped surface at the maximum bottom dead point (a soft rock), and for a sensor, which is the closest to a rear end of the piston 1440, to detect a stepped surface at the minimum bottom dead point (a hard rock).

That is, a distance between the plurality of sensors may be similar to or slightly greater than a distance between the bottom dead points at the hard rock and the soft rock.

In this arrangement, when the front stepped surface of the large diameter portion is detected, the rock may be a hard rock when the number of sensors turned off increases, and the rock may be a soft rock when the number of sensors turned on increases. Conversely, when the rear stepped surface of the large diameter portion is detected, the rock may be a hard rock when the number of sensors turned on increases, and the rock may be a soft rock when the number of sensors turned off increases.

Meanwhile, as shown in FIG. 4, it is not necessary for the proximity sensor 2200 to be disposed to detect the rear large diameter portion 1444 of the piston 1440. For example, as shown in FIG. 5, it is possible that the proximity sensor 2200 is disposed to detect the front large diameter portion 1442 of the piston 1440.

The proximity sensor 2200 may be appropriately disposed at various positions of the cylinder 1430 as needed in addition to the positions shown in FIG. 4 or 5. FIG. 6 is such an example.

FIG. 6 is a view of an example in which the proximity sensor 2200 according to the embodiment of the present invention is disposed.

Referring to FIG. 6, the proximity sensor 2200 may be positioned at a position at which the rear large diameter portion 1444 is detected when the piston 1440 moves forward and the front large diameter portion 1442 is detected when the piston 1440 moves backward. In this case, the plurality of proximity sensors 2200 may be disposed in the cylinder 1430 in a longitudinal direction of the cylinder 1430.

According to a state in which the proximity sensor 2200 is disposed as shown in FIG. 6, a breaking condition may be obtained according to whether each of the sensors 2202, 2204, and 2206 detects the rear large diameter portion 1444 when the piston 1440 moves forward. This will be described with reference to FIGS. 7 to 9.

Figure 7:
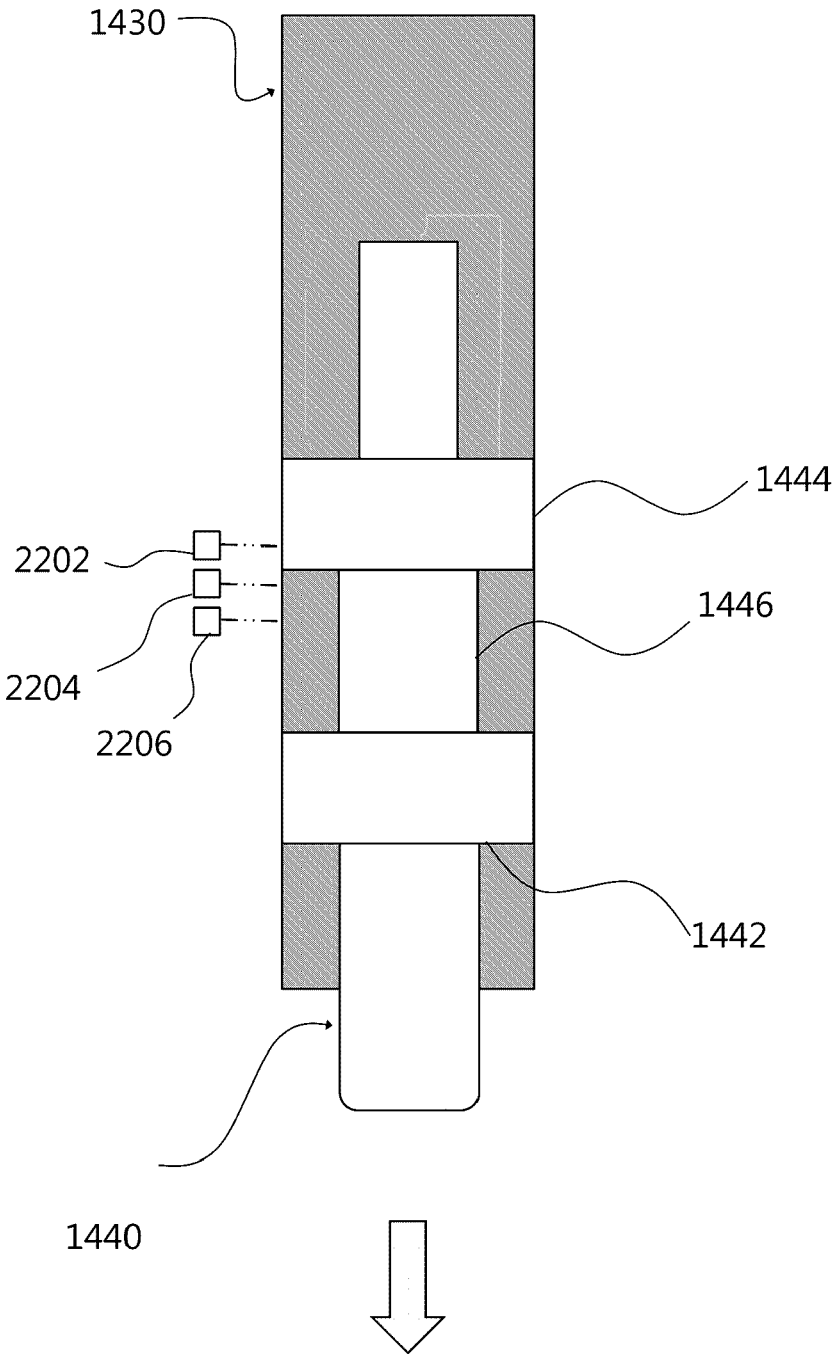
FIG. 7 is a view showing a bottom dead point of a piston when a hard rock is broken in a state in which the proximity sensor is disposed according to FIG. 6.

FIG. 7 is a view showing a bottom dead point of the piston 1440 when a hard rock is broken in a state in which the proximity sensor 2200 is disposed as shown in FIG. 6. Referring to FIG. 7, when the piston 1440 breaks a hard rock, the piston 1440 is suppressed by repulsive force of the hard rock from moving forward, and thus only the rear sensor 2202 may detect the rear large diameter portion 1444, and the other sensors 2204 and 2206 may not detect the rear large diameter portion 1444. In this case, even when the rear sensor 2202 cannot detect the rear large diameter portion 1444, the rock may be determined as a very hard rock.

Figure 8:
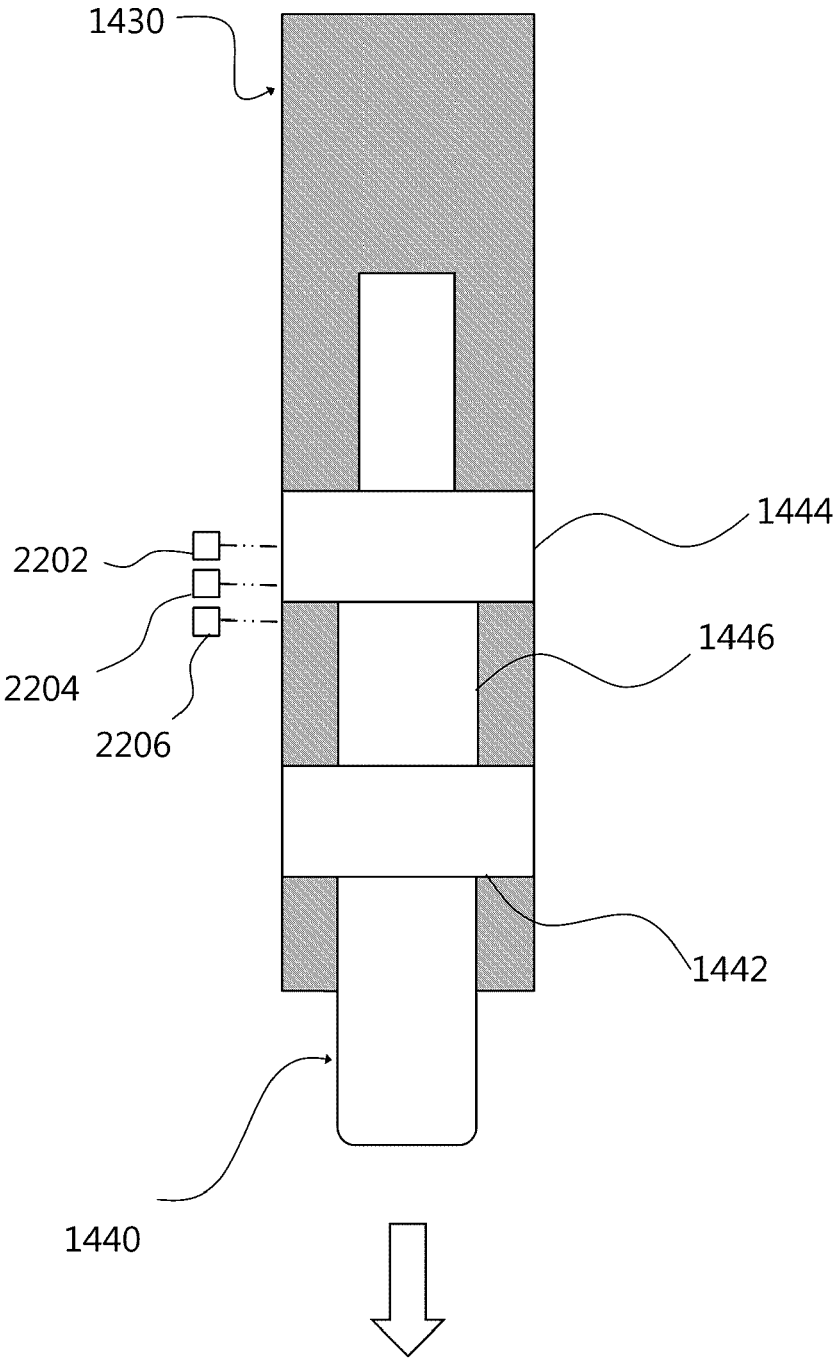
FIG. 8 is a view showing a bottom dead point of a piston when a medium rock is broken in the state in which the proximity sensor is disposed according to FIG. 6.

FIG. 8 is a view showing a bottom dead point of the piston 1440 when a medium rock is broken in the state in which the proximity sensor 2200 is disposed according to FIG. 6. Referring to FIG. 8, when the piston 1440 breaks the medium rock, the piston 1440 is suppressed by repulsive force of the medium rock from moving forward. In this case, the repulsive force of the medium rock is weaker than that of the hard rock, and thus the rear sensor 2202 and the mid sensor 2204 may detect the rear large diameter portion 1444 and may not detect the front sensor 2206.

Figure 9:
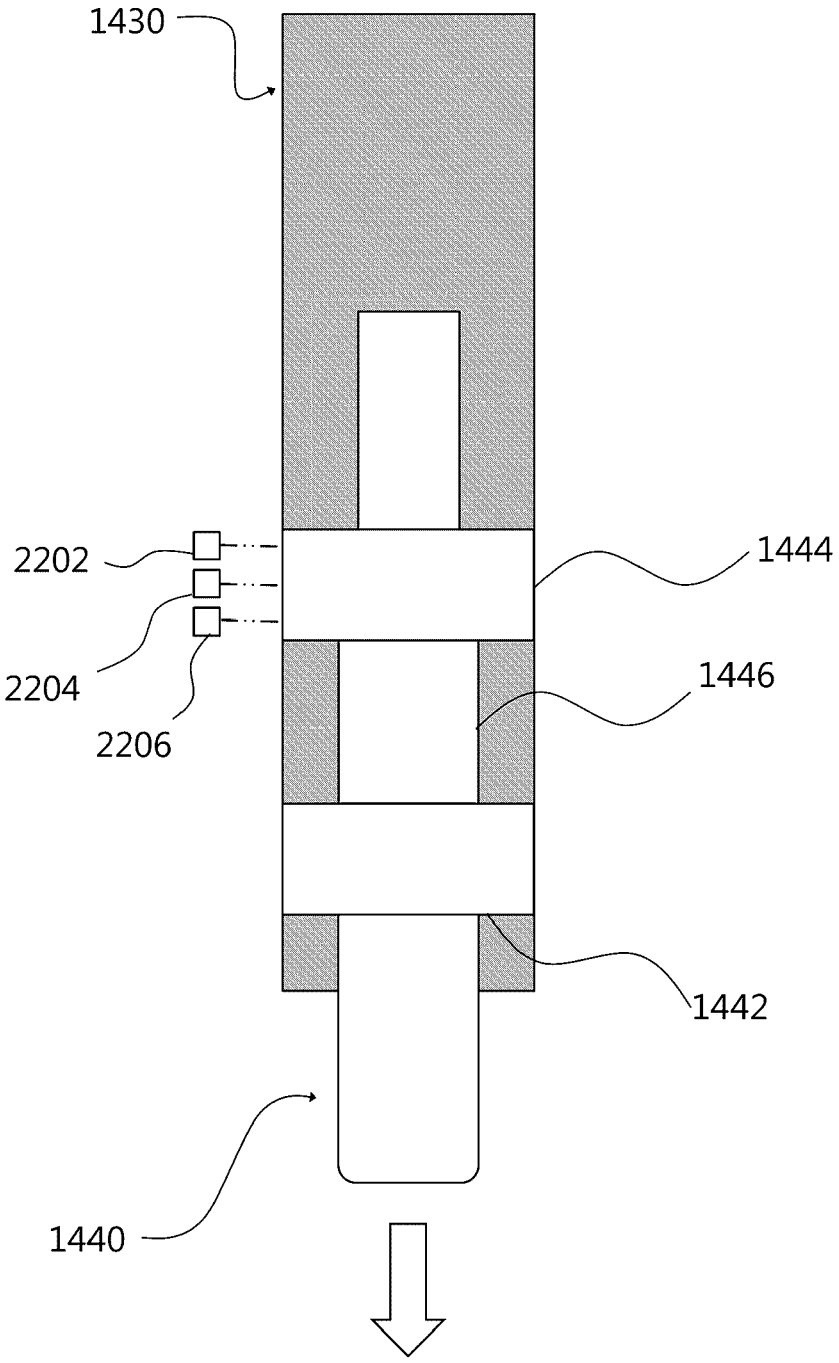
FIG. 9 is a view showing a bottom dead point of a piston when a soft rock is broken in the state in which the proximity sensor is disposed according to FIG. 6.

FIG. 9 is a view showing a bottom dead point of the piston 1440 when a soft rock is broken in the state in which the proximity sensor 2200 is disposed according to FIG. 6. Referring to FIG. 9, when the piston 1440 breaks a soft rock, a repulsive force weaker than even that of the medium rock is applied, and thus all the sensors 2202, 2204, and 2206 may detect the rear large diameter portion 1444.

Based on the above description, in the above-described arrangement state shown in FIG. 6, hardness of the object to be broken can be confirmed according to whether the proximity sensors 2202, 2204, and 2206 are turned on or off.

Figure 10:
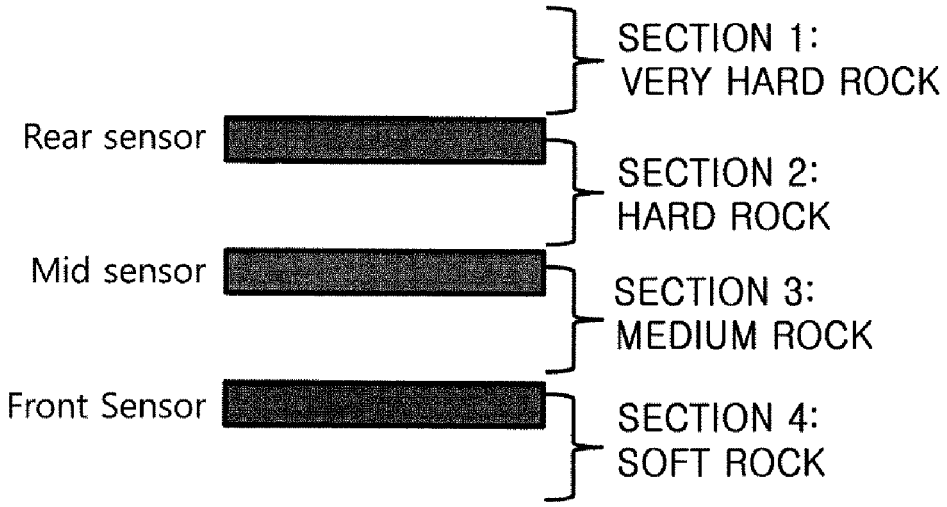
FIG. 10 is a view showing a sensing section according to hardness of an object to be broken of the proximity sensor disposed according to FIG. 6.

FIG. 10 is a view showing a sensing section according to hardness of an object to be broken of the proximity sensor 2200 disposed according to FIG. 6, and FIG. 11 is a table for determining the hardness of an object to be broken according to a detection result of the proximity sensor 2200 disposed according to FIG. 6.

Referring to FIG. 10, when the object to be broken is a very hard rock, the bottom dead point of the rear large diameter portion 1444 is positioned behind the rear sensor 2202, and when the object to be broken is a hard rock, the bottom dead point of the rear large diameter portion 1444 is positioned between the rear sensor 2202 and the mid sensor 2204. When the object to be broken is a medium rock, the bottom dead point of the rear large diameter portion 1444 is positioned between the mid sensor 2204 and the front sensor 2206, and when the object to be broken is a soft rock, the bottom dead point of the rear large diameter portion 1444 is positioned before the front sensor 2206.

Therefore, the controller 180 described below receives a signal from the proximity sensor 2200 and may analyze rock properties based on the signal. FIG. 11 is a table showing a determination result according to each case.

The determination may be made simply based on an on/off state but may be clarified more based on a signal of each of the sensors 2202, 2204, and 2206 on a time line. Particularly, even when the proximity sensor 2200 detects a current proximity signal, the proximity sensor 2200 cannot distinguish whether the object to be detected is the front large diameter portion 1442 or the rear large diameter portion 1444, and thus, for more accurate determination, the proximity sensor 2200 should consider whether the piston 1440 is in a forward state or a backward state or observe the type of signal on the time line.

Figure 12:
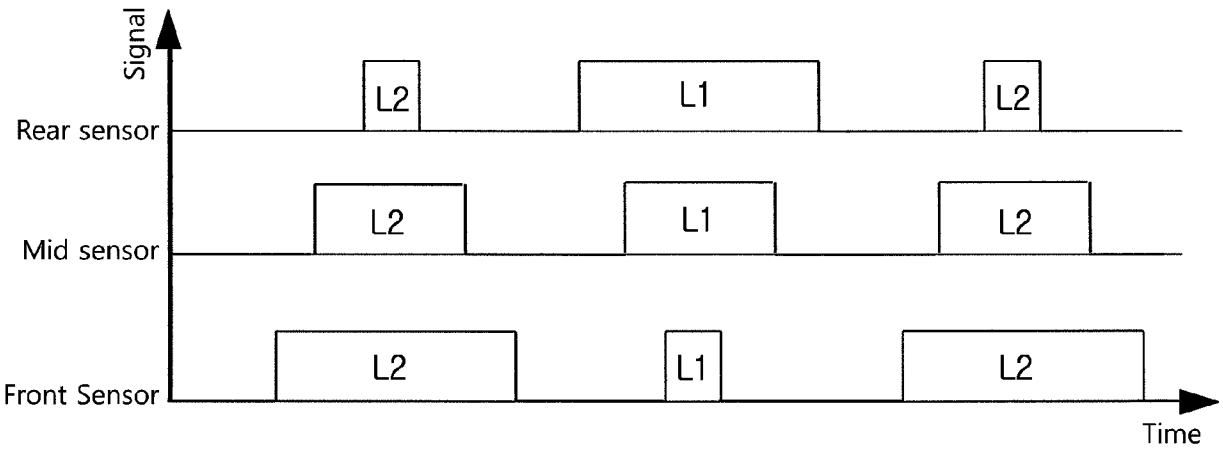
FIG. 12 is a graph showing a signal of the proximity sensor when a soft rock is broken in the state in which the proximity sensor is disposed according to FIG. 6.
Figure 13:
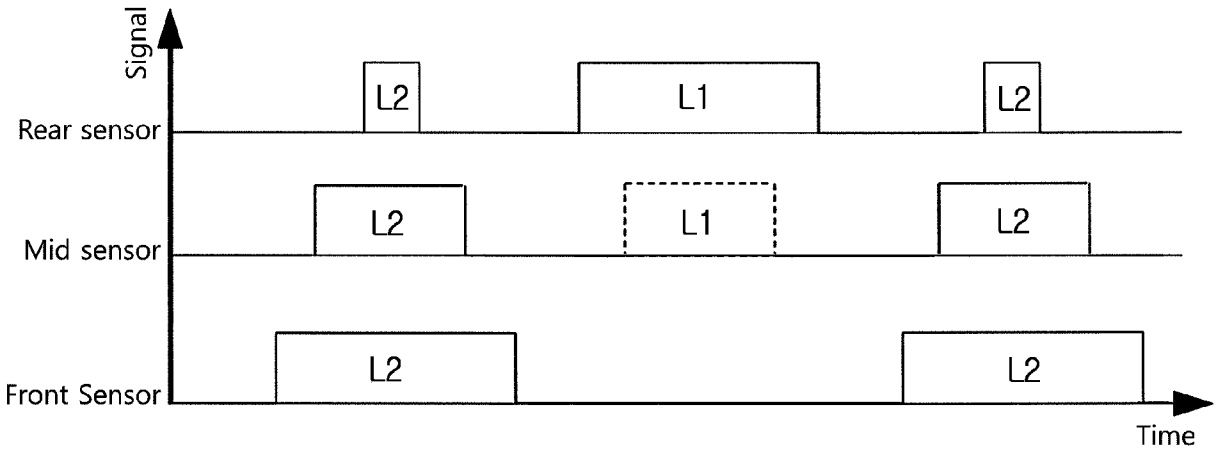
FIG. 13 is a graph showing a signal of the proximity sensor when a hard rock or a medium rock is broken in the state in which the proximity sensor is disposed according to FIG. 6.

FIG. 12 is a graph showing a signal of the proximity sensor 2200 when a soft rock is broken in the state in which the proximity sensor 2200 is disposed according to FIG. 6, and FIG. 13 is a graph showing a signal of the proximity sensor 2200 when a hard rock or a medium rock is broken in the state in which the proximity sensor 2200 is disposed according to FIG. 6. In FIGS. 12 and 13, "L 2" refers to the front large diameter portion 1442, and "L 1" refers to the rear large diameter portion 1444.

Referring to FIG. 12, when the percussion device 1000 moves backward for first breaking when an operation of breaking a soft rock starts, the front sensor 2206 first detects the front large diameter portion 1442, and the mid sensor 2204 and the rear sensor 2202 are sequentially turned on by the front large diameter portion 1442 as the piston 1440 gradually moves backward.

In this state, when the piston 1440 moves forward, the rear sensor 2202, the mid sensor 2204, and the front sensor 2206 are sequentially turned off.

When the front end of the piston 1440 approaches near the breaking point, the rear sensor 2202 detects the rear large diameter portion 1444 and turns on. In this state, when the piston 1440 is lowered more according to a breaking degree of soft rock, the rear sensor 2202, the mid sensor 2204, and the front sensor 2206 are sequentially turned on.

Therefore, since a case when the front sensor 2206 is time-serially turned on first means that the piston 1440 moves backward, it can be confirmed that hardness of the object to be broken is not reflected.

Further, since a case when only the rear sensor 2202 is time-serially turned on first means that the piston 1440 moves forward, the hardness of the object to be broken can be determined according to whether the proximity sensor 2200 is turned on/off. In FIG. 12, when the entire sensor 2200 is turned on, it can be confirmed that a breaking operation is performed on the soft rock. Although it will be described below, the controller 180 may make a determination based on a signal received from the proximity sensor 2200.

Referring to FIG. 13, when the percussion device 1000 initially moves backward for an operation of breaking a hard rock, the front sensor 2206 first detects the front large diameter portion 1442, and the mid sensor 2204 and the rear sensor 2202 are sequentially turned on by the front large diameter portion 1442 as the piston 1440 gradually moves backward.

In this state, when the piston 1440 moves forward, the rear sensor 2202, the mid sensor 2204, and the front sensor 2206 are sequentially turned off.

When the front end of the piston 1440 approaches near the breaking point, the rear sensor 2202 detects the rear large diameter portion 1444 and turns on. In this state, when the piston 1440 is not lowered more due to a lesser or small degree by which the hard rock is caved in, the rear sensor 2202, the mid sensor 2204, and the front sensor 2206 are not turned on.

Therefore, since a case when the front sensor 2206 is time-serially turned on first means that the piston 1440 moves backward, it can be confirmed that hardness of the object to be broken is not reflected.

Further, since a case when only the rear sensor 2202 is time-serially turned on first means that the piston 1440 moves forward, the hardness of the object to be broken can be determined according to whether the proximity sensor 2200 is turned on/off. In FIG. 13, when only the rear sensor 2202 of the proximity sensor 2200 is turned on, it can be confirmed that the object to be broken is a hard rock. Further, in FIG. 13, when only the rear sensor 2202 and the mid sensor 2204 of the proximity sensor 2200 are turned on, it can be confirmed that the object to be broken is a medium rock. Although it will be described below, the controller 180 may make a determination based on the signal received from the proximity sensor 2200.

Meanwhile, it may be determined whether the piston 1440 moves forward or backward based on a combination of signals without the time series process of the sensors.

Therefore, the forward position or forward movement of the piston 1440 may be determined based on a case in which the rear sensor 2202 is turned on as shown in FIG. 11.

The proximity sensor 2200 may transmit an electronic signal reflecting the detected on/off value to the controller 180. The proximity sensor 2200 and the controller 180 may be connected with a communication module 2210 for transmitting or receiving information. The communication module 2210 may allow data to be transmitted or received between the controller 180 and the proximity sensor 2200 in a wireless or wired manner. However, when the proximity sensor 2200 and the controller 180 are connected in a wired manner, it is preferable that the proximity sensor 2200 and the controller 180 are connected in a wireless manner due to damage to a wire caused by repetition of the reciprocating motion for the properties of the percussion device 1000. A representative example of the wireless communication includes Bluetooth low energy (BTLE) or ZigBee. Since a communication between the proximity sensor 2200 and the controller 180 does not require a high bandwidth, low power communication may be preferable. However, in the present invention, the communication between the proximity sensor 2200 and the controller 180 is not limited thereto.

The controller 180, which is an electronic circuit for processing and calculating various electronic signals, may receive a signal from the sensor, calculate information/data, and control other components of the construction equipment 100 using an electronic signal.

The controller 180 is generally positioned in the carrier 120 but may be positioned in the percussion device 1000. Further, it is not necessary that the controller 180 is formed as a single object. The controller 180 may be formed as a plurality of controllers 180 communicating with each other as needed. The controller 180 may be dispersedly disposed, for example, a part of the controller 180 may be installed in the percussion device 1000, and the other parts thereof may be installed in the carrier 120, and the dispersedly disposed controllers 180 may communicate with each other in a wired or wireless manner to perform a function thereof. When the plurality of controllers 180 are dispersedly disposed, some of the controllers 180 as a slave type simply transmit only a signal or information, and the remaining controllers 180 as a master type receive various signals or information and perform processing/calculation and command/control.

The controller 180 may determine a breaking condition (for example, properties of the object to be broken, such as hardness of rock, when the rock is broken) according to the input electronic signal. Specifically, the controller 180 may determine a breaking condition based on an on/off state and an on/off time of each of the sensors 2202, 2204, and 2206 according to the input electronic signal. For example, in a case when the sensors are sequentially turned on in order from the front sensor 2206 to the rear sensor 2202 by the input electronic signal when the rock is broken, the signal is generated when the piston 1440 moves backward, and thus the controller 180 does not use the signal as determination data for the properties of the rock. Conversely, in a case when the sensors are sequentially turned on in order from the rear sensor 2202 to the front sensor 2206 by the input electronic signal when the rock is broken, the signal is generated when the piston 1440 moves forward, and thus the controller 180 may determine the properties of the rock based on the on/off state of each of the sensors 2202, 2204, and 2206 as shown in a table of FIG. 11. As shown in the table of FIG. 11, the properties of the rock may be roughly determined with a combination of turning on/off of the proximity sensor 2200, but an order in which each of the sensors 2202, 2204, and 2206 is turned on should be additionally considered to prepare the state where all the sensors are turned off or off.

When the breaking condition is determined, the controller 180 may adjust a stroke distance using the transmission valve 1470. For example, when the rock is determined as a hard rock, the controller 180 outputs an off-signal to the transmission valve 1470, and a solenoid valve is disposed at the long stroke position 1470-1, and thus the percussion device 1000 may be operated in the long stroke mode. Conversely, when the rock is determined as a soft rock, the controller 180 outputs an on-signal to the transmission valve 1470, and a solenoid valve is disposed at the short stroke position 1470-2, and thus the percussion device 1000 may be operated in the short stroke mode.

According to the above description, the proximity sensor 2200 detects a bottom dead point of the rear large diameter portion 1444, reflecting the properties thereof according to a breaking condition when the percussion 1000 is operated. The controller 180 sets a stroke mode based on a combination of turning on/off of the detected proximity sensors 2202, 2204, and 2206 and an order of turning on/off thereof and controls the transmission valve 1470 according to the set stroke mode. The transmission valve 1470 may adjust a stroke distance of the percussion device 1000 according to the long strode mode or the short stroke mode. In other words, the percussion device 1000 may perform an automatic stroke distance adjustment function of automatically adjusting a stroke distance according to the breaking condition.

In the above description, although it has been mainly described that the three sensors 2202, 2204, and 2206 are provided at the front, middle, and rear ends of the piston 1440 as the proximity sensors 2200, only one or two proximity sensors 2200 are used to save costs, or four or more proximity sensors 2200 may be used to increase precision. Further, it is not necessary for the proximity sensor 2200 to be disposed to detect the rear large diameter portion 1444, and the proximity sensor 2200 may detect other objects reflecting the reciprocating motion and a position of the bottom dead point of the piston 1440 based on a combination of turning on/off of the sensors or may be disposed at another position.

Meanwhile, according to the above description, the percussion device 1000 may perform a two-stage transmission in which the percussion device 1000 is operated in the long stroke mode when a rock is a hard rock and is operated in the short stroke mode when a rock is soft rock.

However, in the present invention, the percussion device 1000 may also perform three-stage or more transmission or continuous variable transmission.

Hereinafter, operations of three-stage or more transmission or continuous variable transmission according to the embodiment of the present invention will be described.

Figure 14:
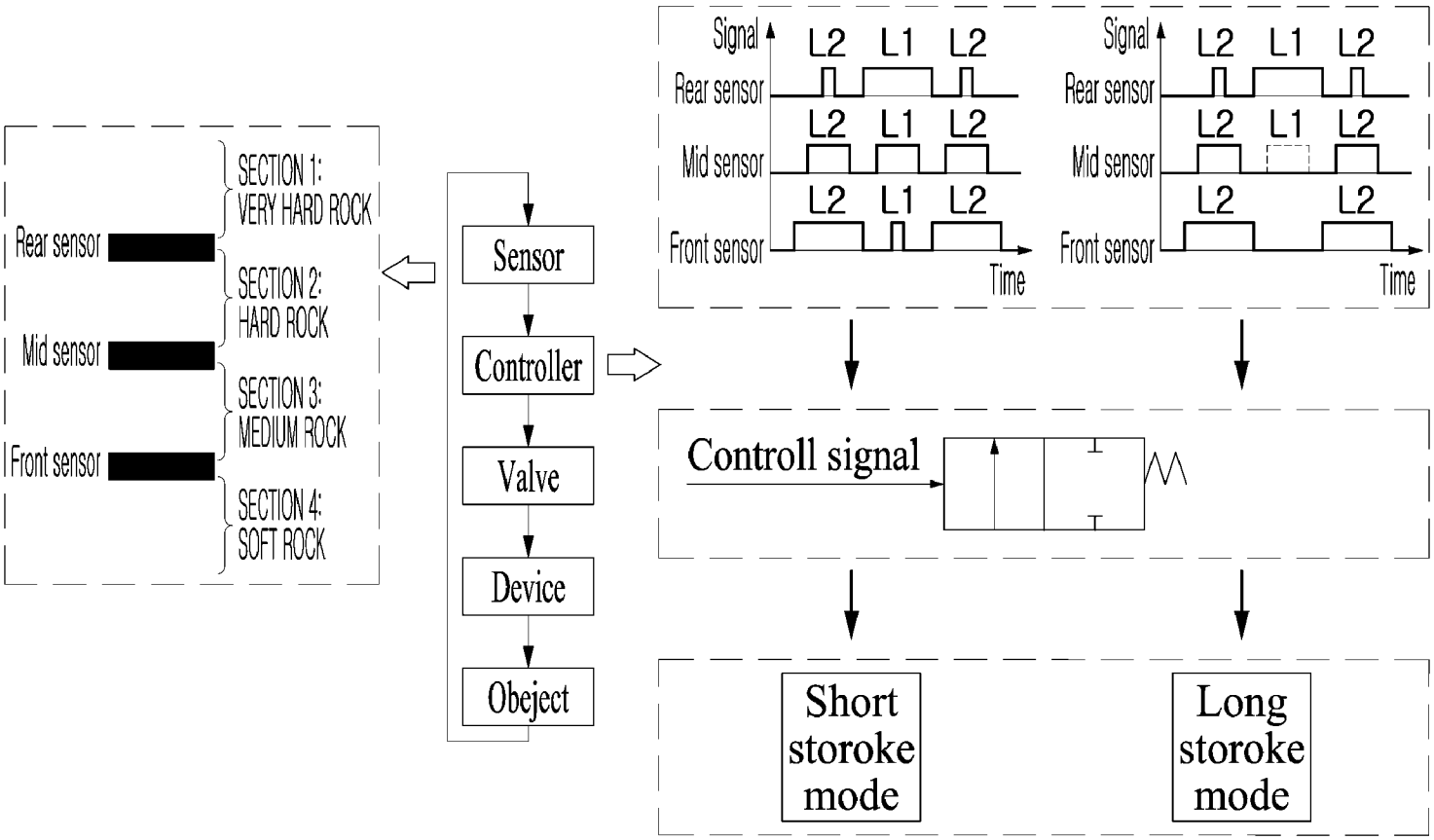
FIG. 14 is a view of an on/off control signal of a controller according to an embodiment of the present invention.

FIG. 14 is a view of an on/off control signal of the controller 180 according to the embodiment of the present invention.

Referring to FIG. 14, when the percussion device 1000 breaks an object to be broken, the proximity sensor 2200 detects a position of a bottom dead point. The controller 180 determines a breaking condition according to a combination of detected turning on/off of the sensors, transmits an on-signal when a strong breaking is required, and transmits an off-signal when a quick breaking is required (the off-signal may not be an actually transmitted signal). In the case of the off-signal, the transmission valve 1470 is disposed at the long stroke position 1470-1, and the percussion device 1000 is operated in the long stroke mode to perform strong breaking by expanding a stroke distance, and when the on-signal is output, the transmission valve 1470 is disposed at the short stroke position 1470-2, and the percussion device 1000 is operated in the short stroke mode to reduce a stroke distance, and thus a quick breaking is performed.

As described above, when the transmission valve 1470 is continuously in the long stroke mode or the short stroke mode when the transmission valve 1470 is controlled according to the on/off signals of the controller 180, the percussion device 1000 may be operated in the long/short stroke modes.

However, in this case, when the signal of the controller 180 is changed in a time-division manner, the transmission valve 1470 reciprocates between the long stroke position 1470-1 and the short stroke position 1470-2, and the piston 1440 may reciprocate a stroke distance which is a middle distance between the long stroke and the short stroke. That is, the percussion device 1000 may be operated as a middle stroke mode.

Figure 15:
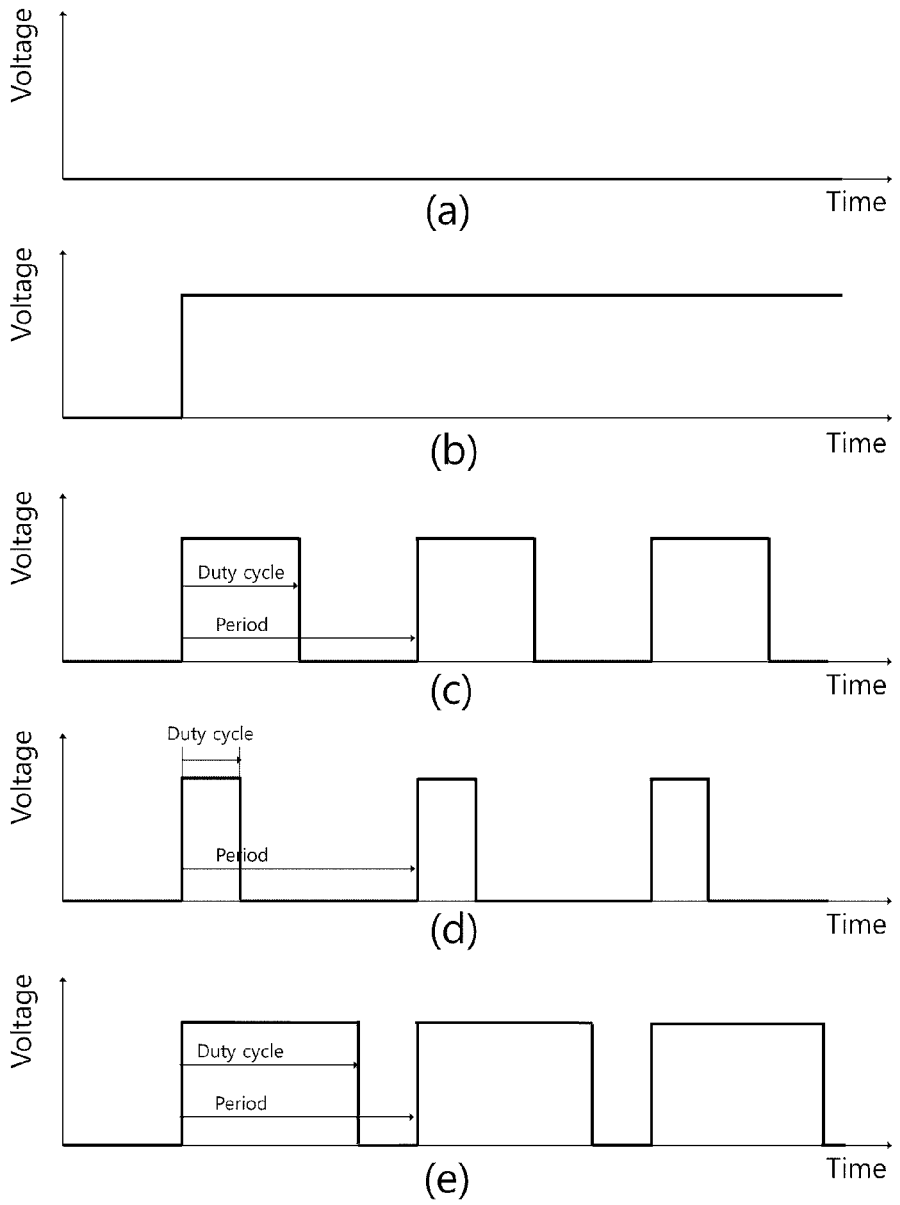
FIG. 15 is a view of a timing signal for three-stage or more or continuously variable transmission according to an embodiment of the present invention.

FIG. 15 is a view of a timing signal for three-stage or more or continuously variable transmission according to an embodiment of the present invention.

FIGS. 15A and 15B show control signals for the long stroke mode and the short stroke mode. In this case, the control signal is a signal input from the controller 180 to the transmission valve 1470. The controller 180 transmits a control signal for a long stroke when a rock is a hard rock and transmits a control signal for a short stroke when a rock is a soft rock based on turning on/off signals detected by the proximity sensor 2200.

In this case, when the controller 180 determines that a rock has properties between a soft rock and a hard rock based on a combination of turning on/off of the proximity sensor 2200, the controller 180 outputs the on/off control signals in a pulse form and controls the transmission valve 1470 to move between the long stroke position 1470-1 and the short stroke position 1470-2 as shown in FIGS. 15C, 15D, and 15E. Therefore, when the transmission valve 1470 moves between the two positions 1470-1 and 1470-2, the piston 1440 reciprocates a middle stroke distance between the long stroke distance and the short stroke distance.

Specifically, the piston 1440 receives forward force in the long stroke mode after passing through the long stroke port 1435 and receives forward force in the short stroke mode after passing through the short stroke port 1436. However, when the transmission valve 1470 is switched between the long stroke mode and the short stroke mode in a time-division manner, the piston 1440 receives forward force only during a duty cycle of a control signal period from a point of time when the front large diameter portion 1442 passes through the short stroke port 1436, and thus the piston 1440 may move backward to a middle distance between the maximum backward movement distance at the time of the long stroke and the maximum backward movement distance at the time of short stroke.

In other words, the controller 180 controls a duty cycle for a pulse signal period while outputting an on/off-control signal as a pulse signal so as to allow the percussion device 1000 to be operated in a middle stroke mode between the long stroke and the short stroke.

Therefore, the controller 180 may control the percussion device 1000 by three-stage transmission of the short/middle/long strokes by adjusting the duty cycle. For example, the controller 180 may operate a middle stroke mode using the pulse signal shown in FIG. 8C.

The controller 180 increases a length of stroke by extending a duty cycle and decreases a length of stroke by reducing the duty cycle so as to perform continuously variable transmission. For example, as shown in FIGS. 15C, 15D, and 15E, the controller 180 may control a stroke distance changed between the long stroke and the short stroke by adjusting a duty cycle in comparison with a pulse signal period.

Meanwhile, in the above-described automatic stroke distance adjustment function, the controller 180 may perform transmission in consideration of a predetermined delay time. In this case, the delay time refers to that the stroke mode is switched after a predetermined time, not immediately, even when a change in breaking condition is detected. In the present invention, an error in a position of bottom dead point detected by the proximity sensor 2200 may occur due to its properties. Although the error does not occur, when the chisel 1600 alternately breaks the hard rock and the soft rock in a state in which the hard rock and the soft rock are mixed, a frequent stroke mode is switched, and thus a problem of a decrease in work efficiency may occur. In this case, it is more efficient when the breaking is performed only in the long stroke mode than when the breaking is alternately performed in the long stroke mode and the short stroke mode.

Therefore, although a combination of turning on/off corresponding to a specific stroke mode is detected, the controller 180 may switch a stroke mode when the same combinations of turning on/off are detected for a predetermined time (for example, a multiple of a reciprocation period of the piston 1440).

For example, although the combination of turning on/off for a soft rock is detected while the long stroke mode is performed on the hard rock for one reciprocation period of the piston 1440, the controller 180 does not switch the long stroke to the short stroke. Instead, the controller 180 counts a detected case in which the short stroke is required. After that, when a predetermined number of the cases in which the short stroke is required is continuously detected, the controller 180 may switch the long stroke to the short stroke. Although the predetermined number of the cases in which the short stroke is required is not continuously detected, when a predetermined number of combinations of turning on/off is detected during a predetermined number of breaking, a mode conversion may be performed. That is, when the properties of soft rock are detected during four breakings of a period of five breakings, the mode may be switched to the short stroke.

Hereinafter, a method of automatically adjusting a stroke distance according to the embodiment of the present invention will be described below.

The method of automatically adjusting a stroke distance includes an operation S110 of transmitting a signal, which is detected by a breaking condition sensor 2000 and reflects a breaking condition, to the controller 180, an operation S120 of determining a breaking condition based on the signal received by the controller 180, and an operation S130 of allowing the controller 180 to control the percussion device 1000 using the transmission valve 1470 to perform a stroke mode corresponding to the determined breaking condition.

While the present invention has been particularly described with reference to the exemplary embodiments, it should be understood by those of skilled in the art that various changes, modifications, and replacements in form and details may be made without departing from the spirit and scope of the present invention. Therefore, the above-described embodiments of the present invention may be implemented separately or in combination.

Therefore, the scope of the present invention is not limited to the embodiments. The scope of the present invention is defined not by the detailed description of the present invention but by the appended claims, and encompasses all modifications and equivalents that fall within the scope of the appended claims.

The invention claimed is:

1. A percussion device that breaks an object, the device comprising:

a cylinder for housing a piston;

a piston for reciprocating in the cylinder;

a backward port for connecting a front chamber being located at a front side of the cylinder to a hydraulic source;

a forward port being formed in a rear chamber being located at a rear side of the cylinder;

a forward-backward valve for controlling forward motion and backward motion of the piston by being positioned at one of a forward position for connecting the forward port to the hydraulic source and inducing the piston to move forward and a backward position for connecting the forward port to a hydraulic discharge line and inducing the piston to move backward;

a control line for moving the forward-backward valve to the forward position when being connected to the hydraulic source;

a long-stroke port for connecting the hydraulic source to the control line through the front chamber when the piston is moved backward to a first position, the long-stroke port being formed between the backward port and the forward fort and being connected to the control line;

a short-stroke port being connected to the hydraulic source through the front chamber when the piston is moved to a second position which is closer to the front side of the cylinder than the first position, the short-stroke port being formed between the backward port and the long-stroke port and being connected to the control line;

a transmission valve being positioned between the short-stroke port and the control line and being positioned at one of a long-stroke position for disconnecting the short-stroke port to the control line and a short-stroke position for connecting the short-stroke port to the control line;

a proximity sensor for detecting a bottom dead point of the piston when a target is broken; and a controller configured to: determine a breaking condition based on the detected bottom dead point and transmit a control signal to the transmission valve based on the determined breaking condition, wherein when the transmission valve is positioned at the long-stroke position, the piston receives a forward force from a time point when the piston is retreated back to the first position and operates as a long-stroke, and when the transmission valve is positioned at the short-stroke position, the piston receives a forward force from a time point when the piston is retreated to the second position where the piston is located before being retreated to the first position and operates as a short-stroke being shorter than the long-stroke.

2. The percussion device according to claim 1, wherein the proximity sensor is installed in the cylinder toward the piston and detects whether a large diameter portion of the piston is located on an installation point.

3. The percussion device according to claim 2, wherein the proximity sensor detects a maximum of the forward position when the object is broken.

4. The percussion device according to claim 2, wherein the proximity sensor comprises each of a plurality of sensors that is installed along a reciprocating direction of the piston.

5. The percussion device according to claim 4, wherein the controller determines the breaking condition based on a combination of on/off signals of each of the plurality of sensors.

6. The percussion device according to claim 5, wherein the controller determines the breaking condition by further considering a timing of on/off signals of each of the plurality of sensors.

7. The percussion device according to claim 6 wherein the controller determines the breaking condition based on the combination of on/off signals when a timing at which each of the plurality of sensors is turned on is an order of sensor which is close to the front end of the cylinder from a sensor close to a rear end of the cylinder, and suspends a determination of the breaking condition based on the combination of on/off signals when the timing at which each of the plurality of sensors is turned on is turned on is an order of sensor which is close to the rear end of the cylinder from a sensor close to the front end of the cylinder.

8. The percussion device according to claim 4, wherein the controller determines the breaking condition based on a sensor closest to a front end of the cylinder among each of the plurality of sensors that are on-state.

9. The percussion device according to claim 1, wherein the breaking condition is a characteristics of rock comprising at least a hard rock and a soft rock.

10. The percussion device according to claim 1, wherein the controller controls the transmission valve to the long-stroke position when the bottom dead point of the piston is equal to or less than a predetermined position and controls the transmission valve to the short-stroke position when the bottom dead point of the piston is equal to or greater than the predetermined position based on the proximity sensor.

11. The percussion device according to claim 1, wherein the controller controls position of the transmission valve by controlling whether a power is applied to the transmission valve.

12. The percussion device according to claim 11, wherein the controller disconnects the power to the transmission valve to control the transmission valve to the long-stroke position and the controller applies the power to the transmission valve to control the transmission valve to the short-stroke position.

13. The percussion device according to claim 1, wherein the controller and the proximity sensor communicate with each other using Zigbee or Bluetooth.

14. The percussion device according to claim 1, wherein the controller transmits a pulse signal having a cycle shorter than a reciprocating cycle of the piston and wherein the transmission valve moves between the long-stroke position and the short-stroke position a plurality of times during one reciprocating cycle of the piston, so that the piston operates as a middle stroke having a middle distance between the long-stroke and the short-stroke.

15. The percussion device according to claim 14, wherein the controller controls a length of the middle stroke by controlling a width of the pulse signal with respect to a cycle of the pulse signal.

16. The percussion device according to claim 1, wherein the percussion device comprises at least a hydraulic breaker used for rock crushing and a hydraulic hammer used for pile driving.

17. The percussion device according to claim 1, wherein the percussion device is an attachment type equipped on a boom or an arm of an excavator.

18. A construction equipment comprising:

a percussion device according to claim 1; and an excavator being equipped with on the percussion device.

19. The construction equipment according to claim 18, wherein the controller is installed in the excavator.

20. A percussion device that is equipped on an end of a boom or an arm of excavator for breaking rock, the device comprising:

a cylinder;

a piston for reciprocating in the cylinder;

a chisel for breaking the rock by a reciprocating motion of the piston;

a solenoid valve for regulating a forward position which a hydraulic pressure for guiding a forward force to the piston is applied to either a first position of the cylinder or a second position backward to the first position;

a proximity sensor for detecting a bottom dead point to the piston when the rock is broken; and a controller configured to: determines a characteristics of the rock based on the bottom dead point which is detected and transmits an electronic signal for controlling the solenoid valve according to the characteristics of the rock.

21. The percussion device according to claim 20, wherein the controller determines that the rock is hard as the bottom dead point is closer to a front end of the cylinder than a predetermined bottom dead point.

22. The percussion device according to claim 21, wherein the controller controls the solenoid valve to adjust the forward position to the first position when the characteristics of the rock is soft rock and to adjust the forward position to the second position when the characteristics of the rock is hard rock.

23. The percussion device according to claim 22, wherein the controller adjusts the forward position to the first position for a part of a reciprocating cycle of the piston and adjusts the forward position to the second position for other part of the reciprocating cycle of the piston when the characteristics of the rock is between the soft rock and the hard rock.

24. The percussion device according to claim 23, wherein the controller transmits the electronic signal as a pulse signal and controls a width of the pulse signal with respect to a cycle of the pulse signal.

25. A percussion device comprising:

a piston for reciprocating and breaking a chisel that crushes an object;

a proximity sensor for detecting a bottom dead point to the piston when the piston breaks the chisel;

a solenoid transmission valve for regulating a reciprocating motion of the piston to a long-stroke mode or a short-stroke mode; and a controller configured to: generates a duty cycle signal based on the detected bottom dead point and continuously shifts the reciprocation motion between the long-stroke mode and the short-stroke mode so that the solenoid transmission valve performs the long-stroke mode and the short-stroke mode in a time division manner by using the duty cycle.

* * * * *